US009229402B2

(12) United States Patent
Kifuku et al.

(10) Patent No.: US 9,229,402 B2
(45) Date of Patent: Jan. 5, 2016

(54) RECORDING DEVICE AND CONTROL METHOD

(75) Inventors: Tomoharu Kifuku, Matsumoto (JP); Ayako Ohashi, Shiojiri (JP); Tomoyuki Oi, Matsumoto (JP); Masahiro Furuya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1448 days.

(21) Appl. No.: 12/909,782

(22) Filed: Oct. 21, 2010

(65) Prior Publication Data

US 2011/0099518 A1 Apr. 28, 2011

(30) Foreign Application Priority Data

Oct. 23, 2009 (JP) ..... 2009-244212
Oct. 28, 2009 (JP) ..... 2009-247420

(51) Int. Cl.
*G03G 15/00* (2006.01)

(52) U.S. Cl.
CPC ..... *G03G 15/5016* (2013.01); *G03G 15/5087* (2013.01); *G03G 2215/00109* (2013.01)

(58) Field of Classification Search
CPC ..... G03G 15/5016; G03G 15/5087; G03G 2215/00109
USPC ..... 715/810
See application file for complete search history.

(56) References Cited

U.S. PATENT DOCUMENTS 5,339,096 A * 8/1994 Beaufort et al. ..... 345/156
5,567,062 A * 10/1996 Tanaka et al. ..... 400/62
6,075,925 A * 6/2000 Downing et al. ..... 715/810
6,396,591 B1 * 5/2002 Harrington et al. ..... 358/1.13
6,916,128 B1 * 7/2005 Petteruti et al. ..... 400/88
7,286,258 B2 * 10/2007 Schnoebelen et al. ..... 358/1.18
2001/0024585 A1 * 9/2001 Koakutsu et al. ..... 400/76
2004/0164166 A1 * 8/2004 Mahany et al. ..... 235/472.02
2005/0134904 A1 * 6/2005 Voskuil ..... 358/1.15
2005/0262533 A1 * 11/2005 Hart et al. ..... 725/40
2006/0064651 A1 3/2006 Ito
2007/0011623 A1 * 1/2007 Billmaier et al. ..... 715/810
2007/0186190 A1 8/2007 Nakashima
2007/0212146 A1 * 9/2007 Lyons et al. ..... 400/82
2009/0021770 A1 * 1/2009 Salgado ..... 358/1.15

FOREIGN PATENT DOCUMENTS

JP 08-249542 A 9/1996
JP 2006-091987 A 4/2006

(Continued)

OTHER PUBLICATIONS

Digital Equipment Corporation. LA120 User Guide. 4th edition, Jun. 1981. 138 pages.*

(Continued)

*Primary Examiner* — Amy M Levy
(74) *Attorney, Agent, or Firm* — Kilpatrick Townsend & Stockton LLP

(57) ABSTRACT

A recording device is disclosed which has a push switch and no display. A menu item is sequentially changed out of a plurality of menu items, which are arranged in a specific order, by operating the push switch. Sub-pluralities of menu items are sequentially skipped based on the continuous operation of the push switch to quickly arrive at a desired menu item, without the need to select each and every menu item in sequential order.

10 Claims, 17 Drawing Sheets

(56) References Cited

FOREIGN PATENT DOCUMENTS

| | | | |
|---|---|---|---|
| JP | 2007-019929 | A | 1/2007 |
| JP | 2007-050667 | A | 3/2007 |
| JP | 2007-207186 | A | 8/2007 |
| JP | 2009-131964 | A | 6/2009 |

OTHER PUBLICATIONS

English Machine Translation for JP2007-050667.
English Machine Translation for JP2009-131964.

* cited by examiner

30

31 32

| SELECTION OPERATION COUNT | MENU ITEM |
|---|---|
| 1 | MENU ITEM M1 |
| 2 | MENU ITEM M2 |
| 3 | MENU ITEM M3 |
| 4 | MENU ITEM M4 |
| 5 | MENU ITEM M5 |
| 6 | MENU ITEM M6 |
| 7 | MENU ITEM M7 |
| 8 | MENU ITEM M8 |
| 9 | MENU ITEM M9 |
| 10 | MENU ITEM M10 |
| 11 | MENU ITEM M11 |
| 12 | MENU ITEM M12 |
| 13 | MENU ITEM M13 |
| 14 | MENU ITEM M14 |
| 15 | MENU ITEM M15 |
| 16 | MENU ITEM M16 |
| 17 | MENU ITEM M17 |
| 18 | MENU ITEM M18 |
| 19 | MENU ITEM M19 |
| 20 | MENU ITEM M20 |
| 21 | MENU ITEM M21 |
| 22 | MENU ITEM M22 |
| 23 | MENU ITEM M23 |
| 24 | MENU ITEM M24 |
| 25 | MENU ITEM M25 |
| 26 | MENU ITEM M26 |
| 27 | MENU ITEM M27 |
| 28 | MENU ITEM M28 |
| 29 | MENU ITEM M29 |
| 30 | MENU ITEM M30 |

FIG. 3

300

310 320

| SELECTION OPERATION COUNT | MENU ITEM |
|---|---|
| 1 | MENU ITEM M1 |
| 2 | MENU ITEM M2 |
| 3 | MENU ITEM M3 |
| 4 | MENU ITEM M4 |
| 5 | MENU ITEM M5 |
| 6 | MENU ITEM M6 |
| 7 | MENU ITEM M7 |
| 8 | MENU ITEM M8 |
| 9 | MENU ITEM M9 |
| 10 | MENU ITEM M10 |

FIG. 13

450

| 460 MENU ITEM | 470 FIRST LED OUTPUT STATE FIELD | 480 SECOND LED OUTPUT STATE FIELD | 490 BLINKING OPERATION FIELD |
|---|---|---|---|
| MENU ITEM M1 | BLINK | BLINK | NOT SYNCHRONIZED |
| MENU ITEM M2 | BLINK | BLINK | SYNCHRONIZED |
| MENU ITEM M3 | ON | BLINK | |
| MENU ITEM M4 | OFF | BLINK | |
| MENU ITEM M5 | BLINK | ON | |
| MENU ITEM M6 | ON | ON | |
| MENU ITEM M7 | OFF | ON | |
| MENU ITEM M8 | BLINK | OFF | |
| MENU ITEM M9 | ON | OFF | |
| MENU ITEM M10 | OFF | OFF | |

FIG. 15

RECORDING DEVICE AND CONTROL METHOD

This application claims priority to Japanese Application No. 2009-244212, filed Oct. 23, 2009 and Japanese Application No. 2009-247420, filed Oct. 28, 2009, the entireties of which are incorporated by reference herein.

BACKGROUND

The present invention relates to a recording device that has an operating unit, and to a control method for this recording device.

Recording devices that are controlled using a hierarchical menu structure are known from the literature. See, for example, Japanese Unexamined Patent Appl. Pub. JP-A-2006-91987. The recording device described in JP-A-2006-91987 has an LCD or other type of display, and operating switches including input buttons, key switches, and cursor keys. The user uses the operating switches to change the selected menu item, and confirms the selected menu item on the display device.

There is a need to improve the operability of the operating switches of a recording device such as described above in which various operations are selected by manipulating an operating switch.

SUMMARY

Recording devices having respective operating units according to embodiments of the present invention address the issues, among others, of prior devices and thus improve the usefulness of the respective operating units.

A first aspect of the invention is a recording device that has an operating unit and, when the operating unit is operated, sequentially changes the menu item that is selected in a menu containing a plurality of menu items arranged in a specific order, wherein the menu item selected in the menu is changed by skipping a number of menu items based on how long the operating unit is operated continuously.

When the operating unit is operated continuously means, for example, that when the operating unit is a push switch, the push switch is operated by being pressed and the depressed state is sustained continuously for some period of time.

With this aspect of the invention, the menu item selected in a menu of plural menu items arranged in a specific order is changed by skipping a number of menu items based on how long the operating unit is operated continuously. Thus, a desired menu item can be selected quickly and operability improved. More particularly, this aspect of the invention enables quickly selecting a desired menu item by the simple operation of continuously operating the operating unit, and operability is thereby improved.

In a recording device according to another aspect of the invention, the menu item selected in the menu is changed by skipping over a specific number of menu items each time a specific time passes while the operating unit is operated continuously.

This aspect of the invention enables quick and easy selection of a menu item, after continuously operating the operating unit for a time corresponding to the position of the menu item to be selected.

In a recording device according to another aspect of the invention, the number of menu items that are skipped increases with the passage of time since operation of the operating unit started.

This aspect of the invention enables easily and more quickly selecting a desired menu item particularly when the number of menu items is large and the desired menu item is far from the menu item that is currently selected.

A recording device according to another aspect of the invention, also has a transportation unit that conveys paper, and a recording unit that prints on paper. Each time the menu item selected in the menu is changed by skipping menu items, the paper is conveyed by the transportation unit without an image being recorded.

Because the paper is conveyed by the transportation unit, without an image being recorded each time the menu item selected in the menu is changed by skipping menu items, the user can know from the roll paper being advanced and the sound resulting from conveying the roll paper that the selected menu item was changed by skipping some items. Based on this recognition, the user can determine the currently selected menu item, and because the roll paper was advanced without recording an image, the resources used for image recording can be conserved.

A recording device according to another aspect of the invention, also has a transportation unit that conveys paper, and a recording unit that prints on paper. Each time the menu item selected in the menu is changed by skipping menu items, information indicating the selected menu item after the menu item is changed is recorded by the recording unit on the paper, and the paper is conveyed by the transportation unit.

Because information indicating the selected menu item after the menu item is changed is recorded by the recording unit on the paper, and the paper is conveyed by the transportation unit, each time the menu item selected in the menu is changed by skipping menu items, the user can visually and clearly determine the currently selected menu item by referring to the information recorded on the roll paper.

A recording device according to another aspect of the invention, also has a transportation unit that conveys paper, and a recording unit that prints on paper. The paper is conveyed by the transportation unit without an image being recorded each time the menu item selected in the menu is changed by skipping menu items while the operating unit is operated continuously, and when continuous operation of the operating unit ends. Information indicating the menu item selected when operation of the operating unit ended is recorded by the recording unit on the paper and the paper is conveyed by the transportation unit.

Each time the menu item selected in the menu is changed by skipping menu items while the operating unit is operated continuously in this aspect of the invention, the paper is conveyed by the transportation unit without an image being recorded on the paper. The user can therefore know from the roll paper being advanced and the sound resulting from conveying the roll paper that the selected menu item was changed by skipping some items, and based on this recognition can determine the currently selected menu item. More particularly, because the roll paper is advanced without recording an image while the operating unit is operated continuously, the resources used for image recording can be conserved. Furthermore, because information indicating the menu item that was selected when operation of the operating unit ended is recorded when continuous operation of the operating unit ends, the user can clearly determine the currently selected menu item visually by simply referring to the information printed on the roll paper.

A recording device according to another aspect of the invention, has an operating unit; a transportation unit that conveys paper; and a recording unit that records on paper. When the operating unit is operated, an image corresponding to the operation is recorded by the recording unit on paper and the paper is conveyed by the transportation unit so that the recorded image can be seen.

When an operating switch or other type of operating unit is operated in this aspect of the invention, an image corresponding to the operation is recorded by the recording unit on roll paper or other paper and the paper is conveyed by the transportation unit so that the recorded image can be seen. Thus, whether or not the operation of the operating switch has been effectively performed can be confirmed without including an LCD device or other type of display (e.g., computer monitor, seven-segment display, vacuum fluorescent display, CRT, plasma, digital display, or the like) which is configurable to display varying numbers, unique symbols, and/or letters, on the recording device, and operability is improved. The size and manufacturing cost of the recording device can also be reduced by not providing a display device.

Further, the recording device according to this aspect of the invention is configured so that the selected menu item can be changed in a menu having a plurality of menu items by operating the operating unit, and each time the operating unit is operated and the selected menu item is changed, an image indicating the menu item after said change is recorded by the recording unit on paper and the paper is conveyed by the transportation unit so that the recorded image can be seen.

With this aspect of the invention an image showing the menu item selected after the menu item is changed is recorded on paper such as roll paper, and the roll paper is then advanced so that the recorded image can be seen, each time the selected menu item changes. Thus, the user can confirm the menu item that is currently selected each time the switch is operated to change the selected menu item.

Further, the recording device according to this aspect of the invention is configured so that the selected menu item can be changed in a menu having a plurality of menu items by operating the operating unit, and when the operating unit is operated and the selected menu item is changed after a specific time has passed since the last time the menu item was changed, an image indicating the menu item after said change is recorded by the recording unit on paper and the paper is conveyed by the transportation unit so that the recorded image can be seen.

With this aspect of the invention an image is recorded on roll paper or other paper medium and the paper is then advanced when the selected menu item changes after a specific time has passed since the last time the menu item changed. Thus, use of resources needed to record an image on the roll paper and convey the roll paper can be reduced compared with a configuration in which an image is recorded on roll paper and the paper is then conveyed each time the selected menu item changes. In addition, the menu item that is selected at the current time can be reliably confirmed, because the menu item is not changed for a specific time after the most recent menu item change.

A recording device according to another aspect of the invention has a plurality of LEDs, and uses the output states of the plural LEDs to report the selected menu item.

This aspect of the invention enables reliable and easy confirmation of the selected menu item, by confirming the output states of the plural LEDs in addition to confirming the image recorded on the roll paper.

Another aspect of the invention includes a method of controlling a recording device that has an operating unit and, when the operating unit is operated, sequentially changes the menu item that is selected in a menu containing a plurality of menu items arranged in a specific order, the control method including a step of detecting the time the operating unit is operated continuously, and changing the menu item that is selected in the menu by skipping over a number of menu items based on the detected time.

With the control method according to this aspect of the invention, the menu item selected in a menu of plural menu items arranged in a specific order is changed by skipping a number of menu items based on how long (the time) the operating unit is operated continuously. Thus, a desired menu item can be selected quickly. More particularly, this aspect of the invention enables quick selection of a desired menu item, by the simple operation of continuously operating the operating unit.

Another aspect of the invention includes a method of controlling a recording device that has an operating unit, a transportation unit that conveys paper, and a recording unit that records on paper. When the operating unit is operated, an image corresponding to the operation is recorded by the recording unit on paper, and the paper is conveyed by the transportation unit so that the recorded image can be seen.

With the control method according to this aspect of the invention, when an operating switch or other type of operating unit is operated, an image corresponding to the operation is recorded by the recording unit on roll paper or other paper and the paper is conveyed by the transportation unit so that the recorded image can be seen. Thus, whether or not the operation of the operating switch has been effectively performed can be confirmed without including an LCD device or other type of display on the recording device. The size and manufacturing cost of the recording device can also be reduced by not providing a display device.

Another aspect of the invention is a computer-readable recording medium on which is recorded a program executable by a control unit that controls a recording device that has an operating unit and, when the operating unit is operated to execute the program, sequentially changes the menu item that is selected in a menu containing a plurality of menu items arranged in a specific order, said program causing the control unit to function so that the menu item selected in the menu is changed by skipping a number of menu items based on how long the operating unit is operated continuously.

By executing this program, the menu item selected in a menu of plural menu items arranged in a specific order is changed by skipping a number of menu items based on how long (the time) the operating unit is operated continuously. Thus, a desired menu item can be selected quickly. More particularly, this aspect of the invention enables quick selection of a desired menu item by the simple operation of continuously operating the operating unit.

Another aspect of the invention includes a computer-readable recording medium on which is recorded a program executed by a control unit that controls a recording device that has an operating unit, a transportation unit that conveys paper, and a recording unit that records on paper, said program causing the control unit to function so that, when the operating unit is operated, an image corresponding to said operation is recorded by the recording unit on paper, and the paper is conveyed by the transportation unit so that the recorded image can be seen.

By executing this program, when an operating switch or other type of operating unit is operated, an image corresponding to the operation is recorded by the recording unit on roll paper or other paper and the roll paper is conveyed by the transportation unit so that the recorded image can be seen. Thus, whether or not the operation of the operating switch has been effectively performed can be confirmed without including an LCD device or other type of display on the recording device, and the size and manufacturing cost of the recording device can also be reduced by not providing a display device.

A recording device according to the present invention enables selection of a desired menu item from a menu of plural menu items by operating an operating unit, and thereby enables quick and easy selection of a desired menu item.

Further embodiments together with a fuller understanding of the invention will become apparent and appreciated by referring to the following description in conjunction with the accompanying drawings.

BRIEF DESCRIPTION OF THE DRAWINGS

FIG. 3 shows an example of a selection operation count table according to an embodiment of the invention.

FIG. 13 shows an example of a selection operation count table according to an embodiment of the invention.

FIG. 15 is a table showing changes in the LED state according to an embodiment of the invention.

DETAILED DESCRIPTION

Embodiments of the present invention are described below with reference to the accompanying figures. It should be understood that numeric references to the embodiments (i.e., first, second, third, etc) are only made for the sake of simplicity and ease of reference. Accordingly, the numeric references are not the only possible embodiments, and thus should be understood to be examples.

Figure 1:
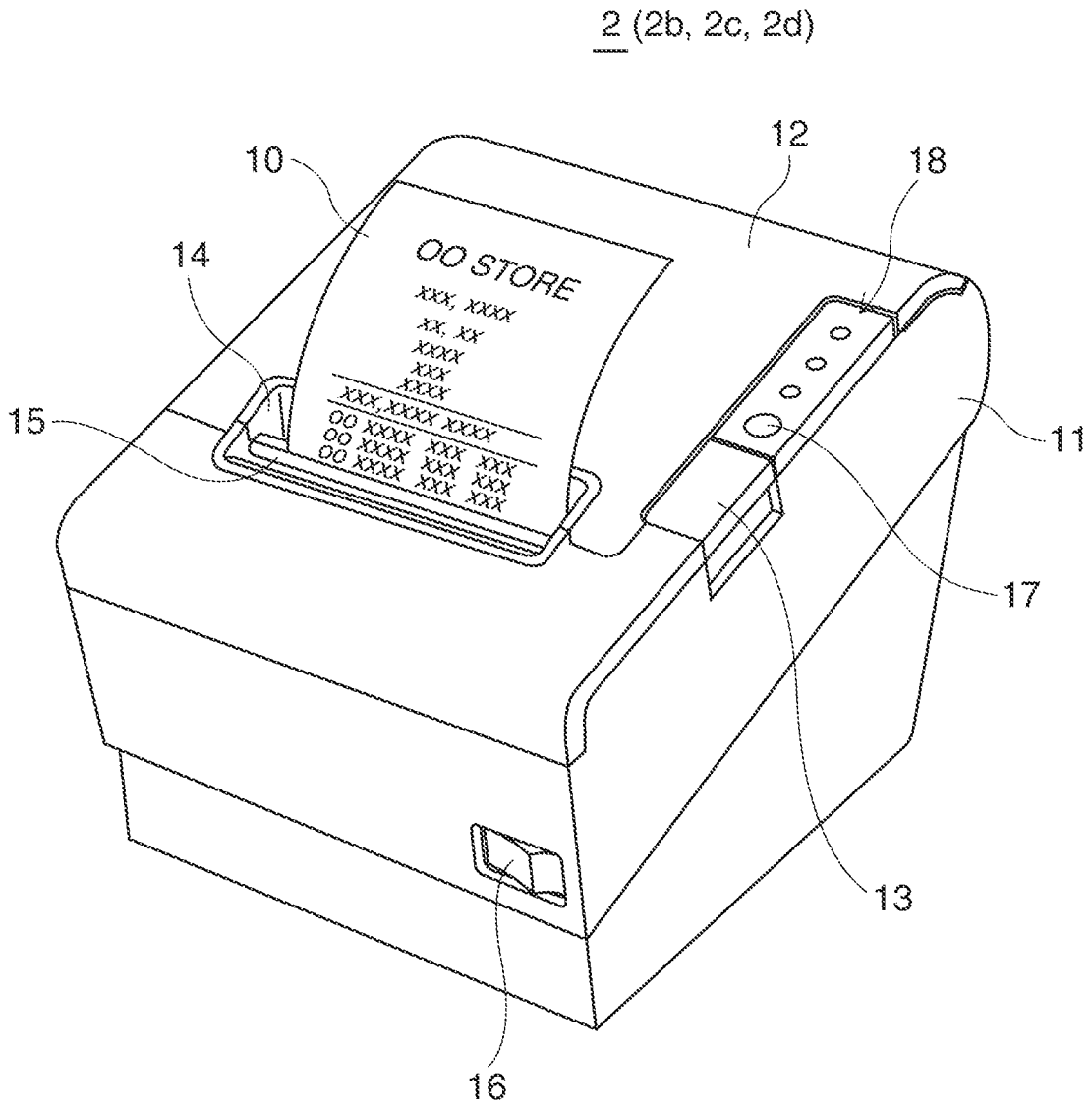
FIG. 1 is an oblique view of a printer according to an embodiment of the invention.

FIG. 1 is an oblique view of a printer 2 according to a first embodiment of the invention.

The printer 2 shown in FIG. 1 as an example of a recording device, or specifically a thermal printer that stores roll paper 10 inside the case 11, and prints text and images on the roll paper 10 by means of a thermal head (not shown in the figure) disposed inside the case 11 while conveying the roll paper 10. A cover 12 that can open and close is disposed to the case 11, and the cover 12 is released by depressing a lever 13. When the cover 12 is opened, a space for storing the roll paper 10 inside the case 11 is exposed, and the roll paper 10 can be loaded or replaced.

The printer 2 prints and outputs receipts in a retail store, for example, by printing (recording) a prepared logo and text on the roll paper 10.

A paper exit 14 for discharging the printed roll paper 10 is formed in the top of the printer 2 case 11. The printer 2 can also be installed with the paper exit 14 facing forward. A cutter 15 for cutting the roll paper 10 is disposed inside the paper exit 14. A power switch 16 for turning the printer 2 power on and off, a push switch 17 (operating switch) for asserting a paper feed instruction or changing the operating mode, for example, and an LED unit 18 for displaying the operating status of the printer 2, for example, are disposed to the case 11.

In addition to a power switch 16, the printer 2 according to this embodiment of the invention only has a push switch 17 as an operating switch (operating unit). The printer 2 also does not have an LCD device or other type of display.

Figure 2:
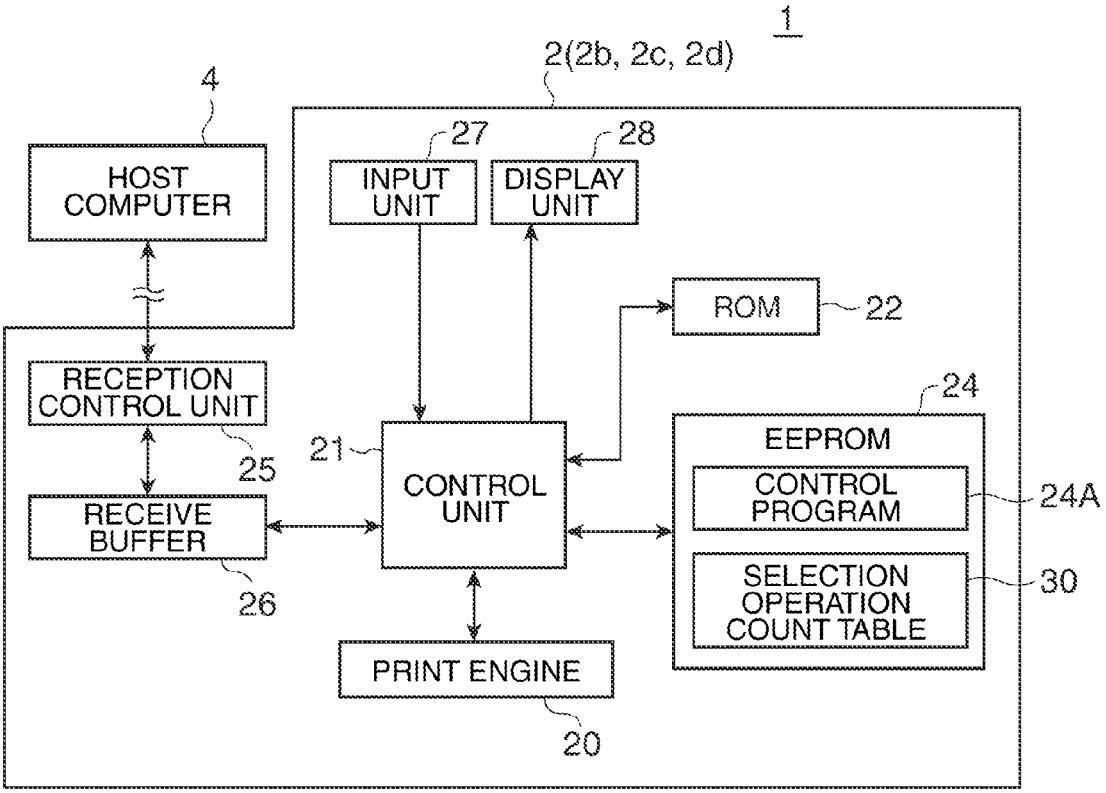
FIG. 2 is a block diagram showing the functional configuration of the printer of FIG. 1.

FIG. 2 is a block diagram showing the configuration of a printing system 1 according to this embodiment of the invention.

The printing system 1 is controlled by connecting a host computer 4 to the printer 2. The printer 2 prints the above-described receipts, for example, according to commands from the host computer 4.

The printer 2 includes a print engine 20 that does the actual printing, a control unit 21 that controls printer 2 operation, ROM 22 that stores the basic control program executed by the control unit 21, EEPROM 24 that stores a control program 24A executed by the control unit 21, a reception control unit 25 that controls receiving commands sent from the host computer 4, a receive buffer 26 that temporarily stores commands and data received from the host computer 4, an input unit 27 that detects operation of the push switch 17, and a display unit 28 that controls the LED unit 18 to display information.

The control unit 21 has a CPU and internal memory used as a working area for temporarily storing data and executed programs, and functions as a microcontroller that executes the basic control program stored in ROM 22 and the control program 24A stored in EEPROM 24. The control unit 21 can also execute various clock functions based on a reference clock generated by an oscillator (not shown), and based on detection signals from the input unit 27 when the switch 17 is pressed, the control unit 21 can count the time from when the switch 17 is pressed, until the switch 17 is released.

The print engine 20 renders the text or image printed on the roll paper 10, as controlled by the control unit 21, based on the print data and commands sent from the host computer 4, and controls the print mechanism of the printer 2 to print on the roll paper 10. More specifically, the printer 2 has a print head that applies heat to the printing surface of the roll paper 10, a print head drive mechanism that causes the print head to move relative to the roll paper 10, and a transportation mechanism that conveys the roll paper 10. The print head and other mechanisms are controlled by the print engine 20. In this embodiment of the invention the print head and print head drive mechanism function as a recording unit that records images on the roll paper 10, and the transportation mechanism functions as a transportation unit that conveys the roll paper 10.

The ROM 22 non-volitively stores a basic control program for initializing the various parts of the printer 2 and controlling said parts by means of the control unit 21, and stores data related to this basic control program.

The EEPROM 24 is a rewritable nonvolatile storage device, and stores the control program 24A for controlling other parts of the printer 2 by means of the control unit 21. The EEPROM 24 also stores a selection operation count table 30. This selection operation count table 30 is described in detail further below.

The reception control unit 25 implements a specific communication protocol for communication with the host computer 4, receives signals sent from the host computer 4, demodulates (decodes) the received signals, and extracts and sequentially stores the commands and data in the receive buffer 26. The reception control unit 25 includes, for example, a connector connected to a communication cable and a communication circuit, or a wireless communication circuit and antenna.

The receive buffer 26 is temporary storage that sequentially stores the commands and data output from the reception control unit 25. The commands and data stored in the receive buffer 26 are acquired by the control unit 21.

The printer 2 executes a print job when a command received by the reception control unit 25 is a command instructing execution of the print job, and print data is received following the command.

Even when not connected to the host computer 4 and used in a stand-alone state, the printer 2 according to this embodiment of the invention can selectively execute such predetermined functions as a function for selecting the type of roll paper 10, a function for setting print density for printing on the roll paper 10, and a function for setting width of the roll paper 10. Note that a user as referred to herein includes the person using the printer 2 as well as maintenance and repair technicians and other people that may operate the printer 2.

More specifically, to use one of the provided functions, the user first enters a setup mode for selecting the operating mode of the printer 2. This setup mode is entered by executing a specific predetermined operation on the printer 2 (such as turning on the power switch 16 while holding the switch 17 depressed).

After setting the operating mode to the setup mode, the user presses the push switch 17 to select the menu item corresponding to the desired function and thereby executes said function.

The operation whereby a particular menu item is selected by the user in this embodiment of the invention is described below. In this embodiment of the invention the user can press to operate the push switch 17 in one of three modes based on how long the push switch 17 is held depressed. These states are referred to herein as operations of selecting, confirming, and skipping menu item selections.

A menu item selection operation is detected when the push switch 17 is pressed continuously for less than 2 seconds.

A confirm operation is detected when the push switch 17 is pressed continuously for more than 2 seconds and less than 4 seconds.

A skip operation is detected when the push switch 17 is pressed continuously for 4 seconds or more.

The menu item that is selected when the user executes the confirm operation, after executing the selection operation a specified number of times, is predefined in this embodiment of the invention. This correlation can be recorded in the operating manual, for example, and thereby be made knowable to the user. There is a 1:1 correlation between menu items and the corresponding functions, and the function corresponding to a particular menu item is executed when that menu item is selected.

In order to execute a particular function on the printer 2, the user must know the menu item corresponding to the desired function and then execute the operation required to select the desired menu item based on this knowledge, such as executing the selection operation six times, and then executing the confirm operation to confirm the selection. This operation results in the menu item being selected and the function corresponding to the menu item being executed.

The operation of the printer 2 when selecting a menu item is described next.

FIG. 3 schematically describes the configuration of the selection operation count table 30.

As shown in FIG. 3, each record in the selection operation count table 30 includes a selection operation count field 31 and a menu item field 32.

The selection operation count field 31 stores the selection operation count denoting the number of times the push switch 17 was pressed in the selection mode before being pressed in the confirm mode.

The menu item field 32 stores menu item data indicating the menu item that was selected, when the push switch 17 is pressed, in the confirm mode, the number of times defined by the selection count stored in the corresponding selection operation count field 31.

As shown in FIG. 3, the menu items are arranged in the selection operation count table 30 in a specific sequence corresponding to the number of times the push switch 17 is pressed in the selection mode. A menu is a group of menu items arranged in a specific order, according to the number of times a selection operation is performed.

As described above, to execute a function, the user presses a button a specific number of times to choose the menu item corresponding to the desired function, and then presses the button to finalize the selection. During this operation the control unit 21 of the printer 2 counts the number of selection operations performed before the confirm operation was performed, and then references the selection operation count table 30 when the confirm operation is executed to retrieve the record in the selection operation count field 31 containing the selection operation count equal to the number of menu item selection operations that was counted. The control unit 21 then gets the menu item data stored in the menu item field 32 of the retrieved record, and reads and executes the program that renders the function corresponding to the menu item identified by the acquired menu item data. More specifically, the operation of the control unit 21 at this time sequentially changes the selected menu item each time the selection operation is performed, and when the confirm operation is performed executes the function corresponding to the currently selected menu item.

The selected menu item is the menu item indicated by the menu item data stored for the selection operation count data, corresponding to the number of times the selection operation was performed until immediately before the confirm operation. Therefore, the menu item that is selected when the confirm operation is performed is confirmed as the selected menu item, and the function corresponding to that menu item is executed.

As shown in FIG. 3, this embodiment of the invention has a menu item M30 denoting a menu item that is selected when the selection operation is executed 30 times. In order to select this menu item M30, the user may therefore perform the selection operation 30 times, a task that is cumbersome and requires much time to select menu item M30. Thus, selecting a desired menu item can be rather time-consuming.

This embodiment, among others, addresses this task by enabling the user to quickly and easily select a desired menu item by means of the operation described below.

Figure 4:
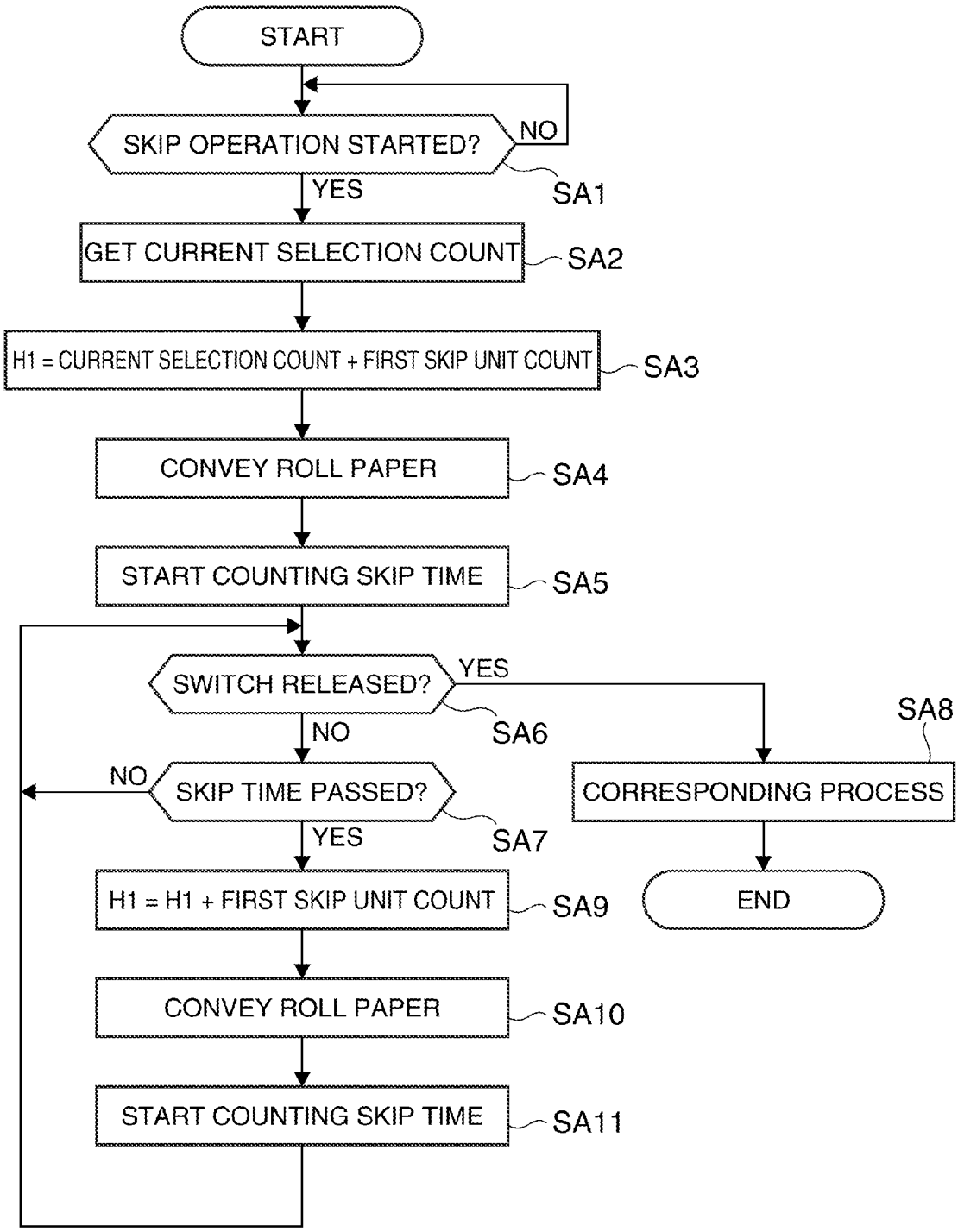
FIG. 4 is a flow chart of printer operation according to an embodiment of the invention.

FIG. 4 is a flow chart describing the operation of the printer 2.

Figure 5:
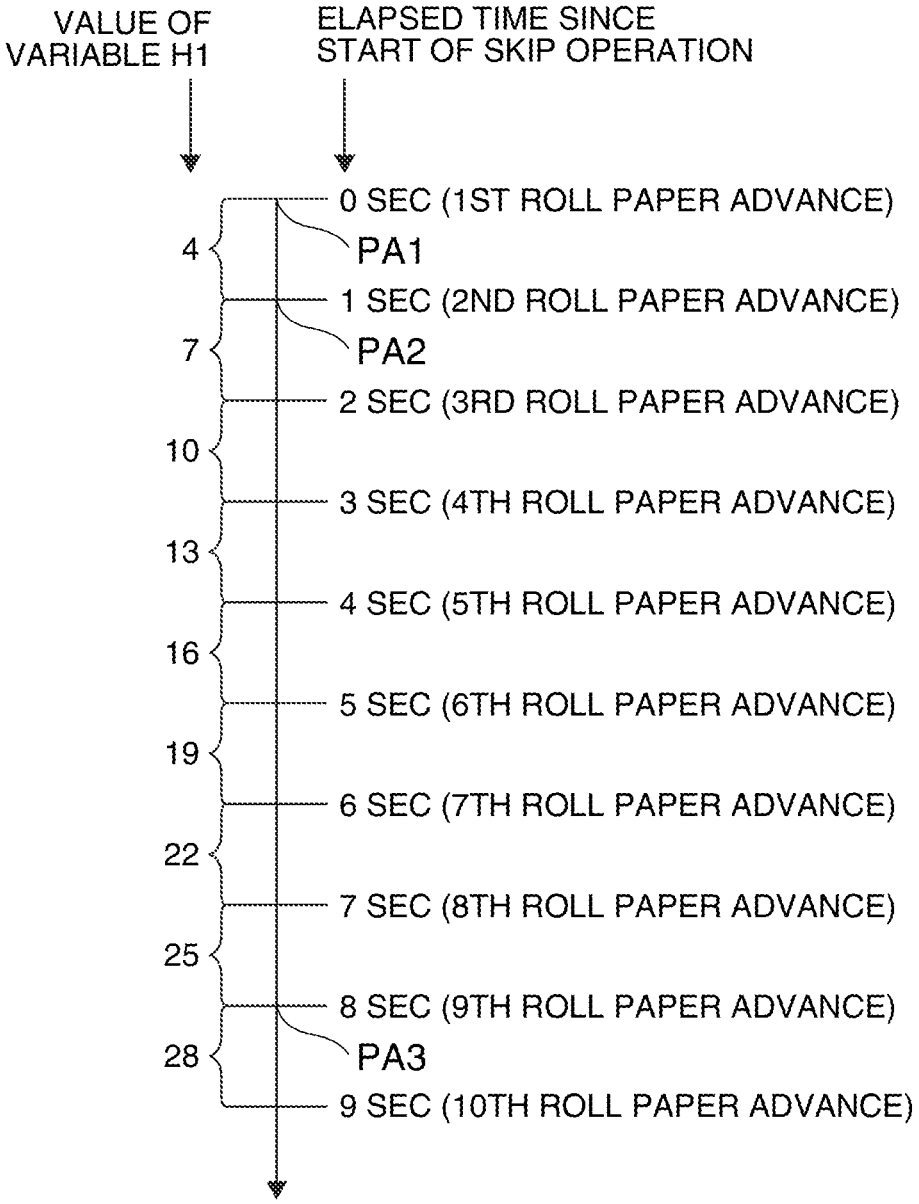
FIG. 5 shows the state of the printer when specific operations shown in the flow chart in FIG. 4 are executed.

FIG. 5 shows the time sequence of the printer 2 state during the operation described in the flow chart in FIG. 4. Note that FIG. 5 shows the state of the printer 2 when the user first executes the selection operation once and then executes the skip operation.

The operation shown in the flow chart in FIG. 4 is rendered by the cooperation of hardware and software components, such as by the control unit 21 executing a control program 24A stored in EEPROM 24.

Described briefly, the operation of the flow chart shown in FIG. 4 causes the printer 2 to skip a specified number (i.e., a sub-plurality) of selectable menu items each time a predetermined time passes while the push switch 17 remains depressed after the skip operation is started.

Referring to FIG. 4, the control unit 21 of the printer 2 monitors whether or not a skip operation was performed (step SA1). As described above, a skip operation is detected when the time that the push switch 17 is held continuously depressed is 4 seconds or longer, and the control unit 21 determines that a menu item skip operation started when the push switch 17 has been held continuously depressed for 4 seconds. When this skip operation starts, that is, when 4 seconds have passed after the push switch 17 is pressed (step SA1 returns Yes), the control unit 21 acquires the number of selection operations that had already been executed by that time (step SA2). The number of selection operations already executed by the current time is stored as data in a variable defined in the control program 24A.

The control unit 21 then adds the sum of the number of selection operations already executed plus a first skip unit count to a variable H1 defined in the control program 24A (step SA3).

This first skip unit count and variable H1 are described below.

As described above, the printer 2 skips a specified number of menu items to change the selected menu item each time a specified time (1 second in this embodiment of the invention) passes after the skip operation is started. The number of selected menu items that are skipped is the first skip unit count.

More specifically, as noted above, when one selection operation is performed once, the menu items that are arranged sequentially according to the number of selection operations change by one menu item when the selection operation is performed once. In the example shown in FIG. 3, when the selection operation is done once, the menu item that is selected is menu item M1. When the selection operation is done again and the number of times the selection operation is executed is 2, the selected menu item changes sequentially to the next menu item and the selected menu item goes to menu item M2.

When the skip operation is done, however, passage of this specified time of 1 second is interpreted as though the selection operation was executed a specified number of times (3 times in this embodiment of the invention), and the selected menu item jumps sequentially three menu items. For example, if the selection operation was executed once when the skip operation starts, the start of the skip operation is interpreted as though the selection operation was executed 3 times and the total number of selection operations goes to 4. In this situation the menu item to be selected goes to menu item M4 and the selected menu item skips from menu item M1 to menu item M4 in FIG. 3. If another 1 second then passes in the skip mode, the selection operation count is incremented 3 and the total number of selection operations goes to 7. In this situation the menu item to be selected goes to menu item M7 and the selected menu item skips from menu item M4 to menu item M7 in FIG. 3.

The variable H1 is a variable for storing data indicating the total number of selection operations detected. This count is referred to herein as the "effective selection count." As described above, the selection operation is interpreted to have been executed a specific number of times each time a specific amount of time passes after the skip operation starts, and this effective selection count is the sum of the selection count indicating the number of selection operations executed before the skip operation was executed, plus the number of times the selection operation is interpreted to have been executed since the skip operation started.

Note that the process shown in step SA3 is equivalent to a process for changing the selected menu item by skipping a certain number of menu items.

Referring again to FIG. 4, after executing step SA3, the control unit 21 controls the print engine 20 to advance the roll paper 10 by means of a transportation mechanism (step SA4). This step SA4 corresponds to point PA1 in FIG. 5. More specifically, the control unit 21 controls the print engine 20 to convey the roll paper 10 the shortest amount required for the user to visually recognize, from the condition of the roll paper 10, that the roll paper 10 was advanced. By conveying the roll paper 10 in this step SA4, the user can also be made aware that the roll paper 10 was advanced from the sound produced by conveying the roll paper 10, and thus recognize that the skip operation started and the selected menu item moved three items. Note that an image is not recorded to the roll paper 10 in step SA4, thereby preventing needless consumption of resources used for printing an image.

The control unit 21 then starts counting the skip time (step SA5). This skip time is time for managing the interval when the selected menu item is changed during the skip operation. In this embodiment of the invention, the skip time is 1 second, and every time the skip time of 1 second passes after the skip operation starts, the selected menu item changes after skipping sequentially as described above.

Next, the control unit 21 monitors whether or not depression of the push switch 17 was released (step SA6), and monitors passage of the skip time (1 second in this embodiment of the invention) from the start of counting the skip time in the foregoing step SA5 or step SA11 described below (step SA7). If the push switch 17 was released (step SA6 returns Yes), the control unit 21 executes the corresponding process (step SA8). Step SA8 is described further below. If the push switch 17 is not released and the skip time passes (step SA7 returns Yes), the control unit 21 adds the first skip unit count to the effective selection count currently stored in the variable H1, and updates the variable H1 to the acquired sum (step SA9). Note that the process in step SA9 is equivalent to a process for sequentially skipping and changing the selected menu item.

The control unit 21 then controls the print engine 20 and conveys the roll paper 10 by means of the transportation mechanism (step SA10). As in step SA4, the user can recognize from the movement of the roll paper 10 and the sounds produced by transporting the roll paper 10 that the selected menu item was changed by sequentially skipping a certain number of menu items. For example, in this embodiment of the invention, the user holding the push switch 17 continuously depressed can know from the roll paper 10 being conveyed once (point PA1 in FIG. 5) that the skip operation started and the selected menu item skipped forward three items, and can know from the roll paper 10 being conveyed a second time (point PA2 in FIG. 5) that the selected menu item skipped forward another three items.

The control unit 21 then starts counting the skip time (step SA11) and returns control to step SA6.

Step SA8 is described next. Step SA8 is a process that is executed when the skip operation ends. If, for example, the confirm operation is executed, the control unit 21 gets the effective selection count stored in the variable H1, references the selection operation count table 30, and retrieves the record in which the selection operation count stored in the selection operation count field 31 matches the acquired effective selection count in step SA8. The control unit 21 also acquires the menu item data stored in the menu item field 32 of the selected record, and executes the function corresponding to the menu item indicated by the acquired menu item data.

However, if in step SA8 the selection operation is executed again, the control unit 21 calculates the sum of the effective selection count stored in the variable H1 plus the number of selection operations, and updates the variable H1 to this sum. Thus, the value stored in the variable H1 reflects the number of selection operations executed after the skip operation ended.

User actions when using the skip operation are described next with reference to FIG. 5.

In this example the user wants to select menu item M30 shown in FIG. 3. To select this menu item M30 without using the skip function, the user must execute the selection operation 30 times and then execute the confirm operation.

In addition, the user has already executed the selection operation once. Menu item M1 is therefore already selected when the operation described below starts.

To select menu item M30 the user presses and holds the push switch 17 continuously depressed. Four seconds after the push switch 17 is pressed, the skip operation starts (point PA1 in FIG. 5). The roll paper 10 is also conveyed so that the user knows therefrom that the skip operation started. The user then counts how many times the roll paper 10 is conveyed while continuing to hold the push switch 17 depressed. After recognizing that the roll paper 10 was advanced 9 times (point PA3 in FIG. 5), the user releases the push switch 17 from the depressed position. At this time the effective selection count stored in the variable H1 is 28. Referring to FIG. 3, because the menu item selected at this time is menu item M28, the user executes the selection operation two more times so that the selected menu item changes to menu item M30. Thus, the effective selection count stored in the variable H1 goes to 30, and the selected menu item changes to menu item M30. The user then executes the confirm operation and confirms menu item M30 as the selected menu item. The function corresponding to menu item M30 is then executed.

When the skip operation is thus used, the menu item M30 can be selected with the extremely simple operation of holding the push switch 17 pressed continuously for approximately 12 seconds, then pressing to select two more times, and then pressing the push switch 17 to finalize the selection. In addition, because the selected menu item skips forward every 1 second during the skip operation, menu item M30 can be selected quickly.

As described above, the menu item selected in a particular menu changes by skipping a specific number of items based on how long the push switch 17 is held continuously depressed.

Because the menu item selected, in a menu having a plurality of menu items arranged in a specific order, changes by sequentially skipping a specific number of items based on the time that the push switch 17 is held continuously depressed, the desired menu item can be quickly selected. More particularly, the desired menu item can be quickly selected by the simple operation of pressing and holding the push switch 17 depressed.

Furthermore, the menu item selected in the menu is changed by sequentially skipping a specific number of items each time a specified time passes while the push switch 17 is held continuously depressed.

Thus, a desired menu item can be quickly and easily selected by selecting the desired menu item after holding the push switch 17 depressed for a time appropriate to the position on the menu of the menu item to be selected.

This embodiment of the invention has a transportation mechanism that functions as a transportation unit, a print head that functions as a recording unit, and a print head drive mechanism, and conveys the roll paper 10 each time the menu item selected in the menu is changed by sequentially skipping a number of items.

Thus, because the roll paper 10 is conveyed without recording an image each time the selected menu item is changed by sequentially skipping a number of items, the user can know from the conveyance of the roll paper and the sound produced by conveying the roll paper that the selected menu item was changed by sequentially skipping a number of items, and based on this recognition can know the currently selected menu item. Yet further, because an image is not recorded when the roll paper is conveyed, the resources that are used to record an image can be saved.

The configuration of a printer 2*b* according to a second embodiment of the invention is the same as the configuration of the printer 2 according to the first embodiment of the invention, and further description thereof with reference to FIG. 1 and FIG. 2 is omitted.

Figure 6:
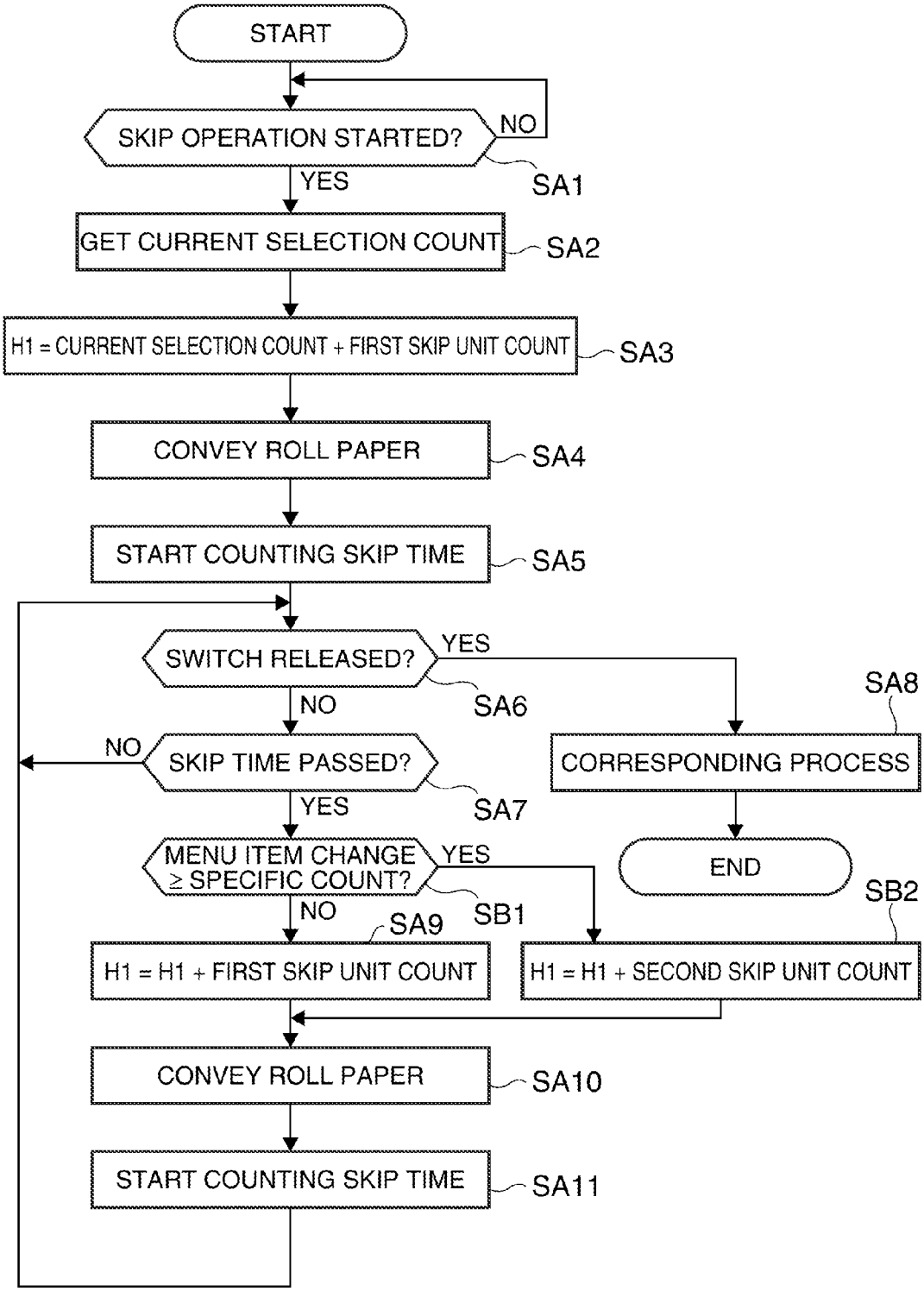
FIG. 6 is a flow chart of the operation of a printer according to an embodiment of the invention.
Figure 7:
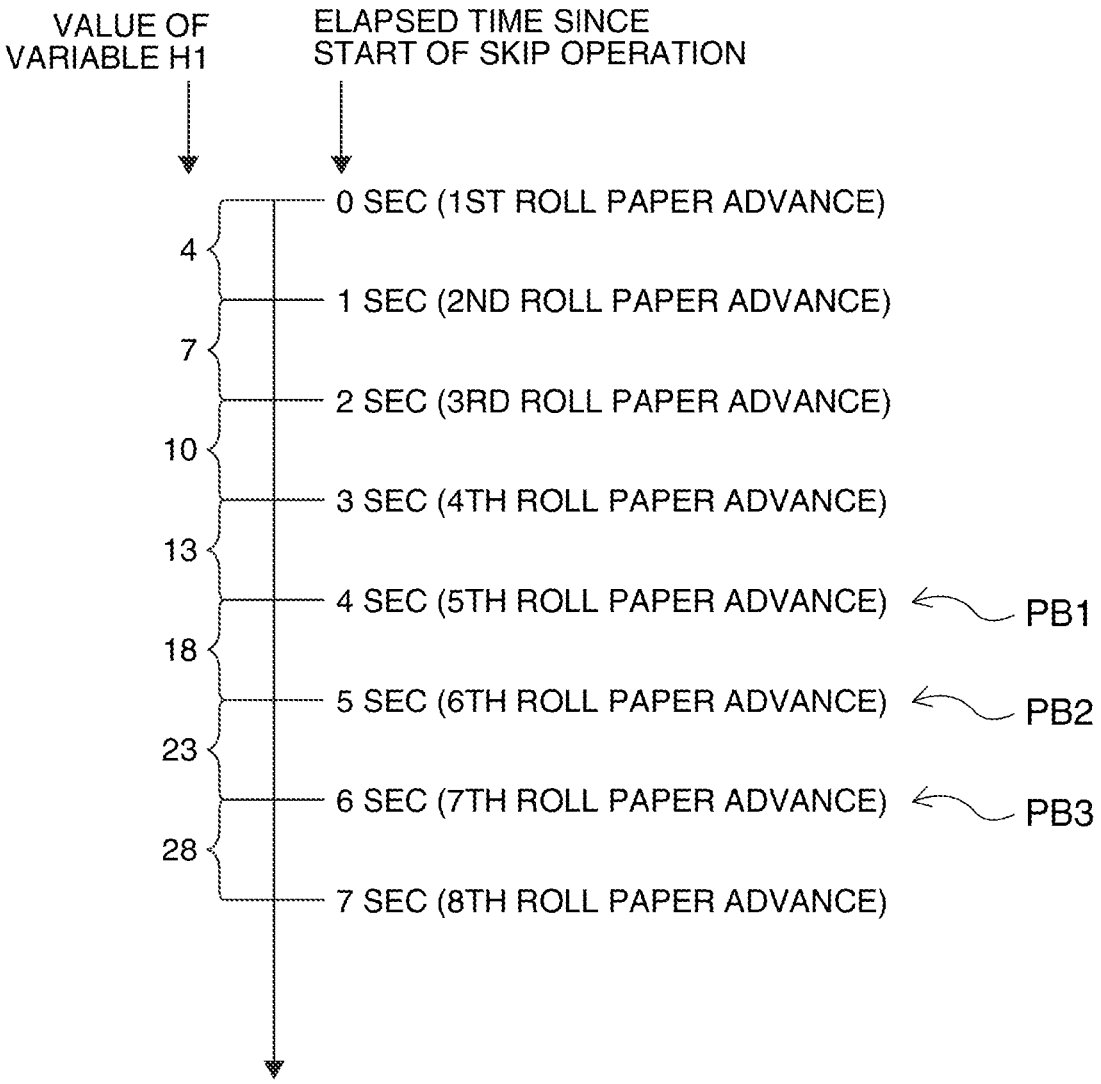
FIG. 7 shows the printer state during the operation described in the flow chart in FIG. 6.

FIG. 6 is a flow chart of the operation of the printer 2*b* according to this embodiment of the invention. FIG. 7 shows the change in the printer 2*b* state over time during the operation shown in the flow chart in FIG. 6.

The printer 2 according to the first embodiment of the invention skips the selected menu item three items forward each time a specific time (1 second) passes after the skip operation starts. In this embodiment of the invention, however, when the menu item has been changed a specific number of times (4 times in this embodiment) after the skip operation starts, the selected menu item is changed by jumping more than 3 items, such as by jumping 5 items in this embodiment.

As will be understood by comparing FIG. 6 and FIG. 4, this embodiment differs from the first embodiment by executing steps SB1 and SB2.

If step SA7 determines that the skip time passed (step SA7 returns Yes), the control unit 21 of the printer 2*b* determines if the number of times the selected menu item changed after the skip operation started is greater than or equal to 4 (step SB1). Whether or not the menu item changed four or more times is determined by determining if step SA3 and step SA9 executed a total of four or more times. If the menu item has changed less than four times (step SB1 returns No), the control unit 21 goes to step SA9.

If the menu item has changed four or more times (step SB1 returns Yes), the control unit 21 stores the sum of the effective selection count currently stored in the variable H1 plus a second skip unit count that is greater than the first skip unit count (which can be 5 in this embodiment of the invention) to variable H1 (step SB2). Step SB2 corresponds to points PB1, PB2, and PB3 in FIG. 7.

As a result of this process, the number of menu items jumped in this printer 2*b* to change the selected menu item increases after the menu item has been changed a specified number of times.

As described above, while the skip operation continues, the number of menu items that are sequentially jumped increases, as the time increases since when the push switch 17 was first pressed.

Thus, this embodiment of the invention enables easily selecting a desired menu item even more quickly particularly when there are many items on the menu and the desired menu item is distant from the currently selected menu item.

The configuration of a printer 2*c* according to a third embodiment of the invention is the same as the configuration of the printer 2 according to the first embodiment of the invention, and further description thereof with reference to FIG. 1 and FIG. 2 is omitted.

Figure 8:
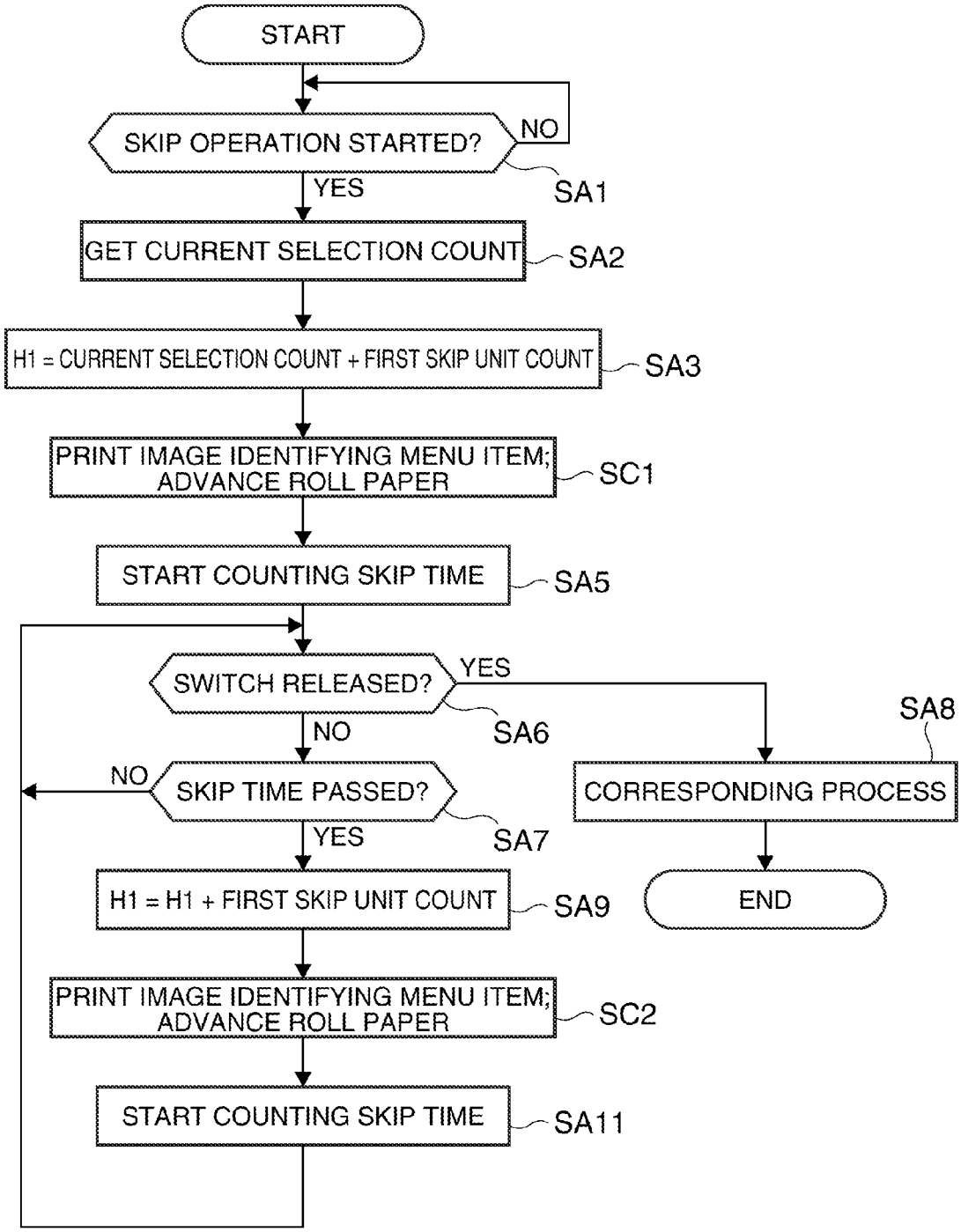
FIG. 8 is a flow chart of the operation of a printer according to according to an embodiment of the invention.

FIG. 8 is a flow chart of the operation of the printer 2*c* according to this embodiment of the invention.

As will be understood by comparing FIG. 8 and FIG. 4, this embodiment differs from the first embodiment by executing step SC1 instead of step SA4, and executing step SC2 instead of step SA10.

In step SC1 the control unit 21 of the printer 2*c* controls the print engine 20 to record information indicating the currently selected menu item on the roll paper 10, and then convey the roll paper 10. Note that the control unit 21 references the selection operation count table 30 to retrieve the record storing the same selection operation count as the effective selection count stored in the variable H1, and gets the menu item data stored in the menu item field 32 of that record to acquire the menu item to be recorded on the roll paper 10.

Likewise in step SC2, the control unit 21 controls the print engine 20, records information indicating the currently selected menu item on the roll paper 10, and then conveys the roll paper 10.

Figure 9:
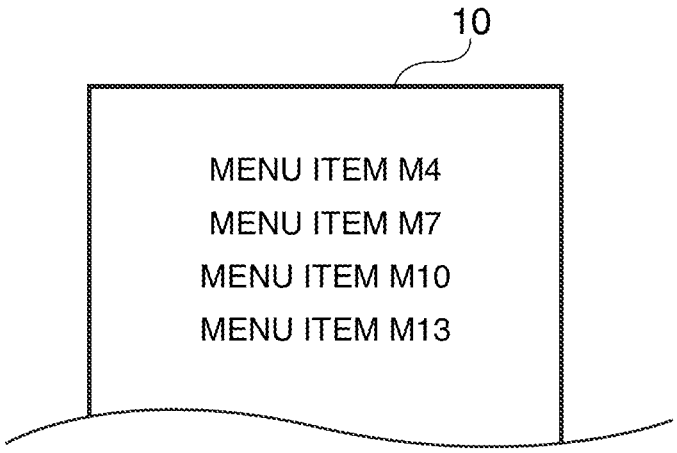
FIG. 9 shows roll paper on which information describing the menu items is recorded according to an embodiment of the invention.

FIG. 9 shows a sample of roll paper 10 on which information indicating menu items was recorded.

Each time the selected menu item is changed by skipping some number of items in this embodiment of the invention, information indicating the menu item selected after the menu item is changed is printed and the roll paper 10 is then advanced. Thus, the user can know the menu item selected after the menu item is changed by simply reading the information printed on the roll paper 10.

More particularly, the printer 2*c* according to this embodiment of the invention does not have a display device but the user can visually check the currently selected menu item without using a display device, and user convenience can be improved.

As described above, information indicating the menu item selected after the selected menu item is changed is printed on the roll paper 10 and the roll paper 10 is advanced in this embodiment of the invention each time the menu item selected in a menu is changed by skipping a number of intervening items.

Thus, because information indicating the menu item that is selected after the menu item is changed is printed on roll paper each time the selected menu item is changed by skipping a number of sequential items, the user can clearly know the currently selected menu item by referring visually to the information printed on the roll paper.

The configuration of a printer 2*d* according to a fourth embodiment of the invention is the same as the configuration of the printer 2 according to the first embodiment of the invention, and further description thereof with reference to FIG. 1 and FIG. 2 is omitted.

Figure 10:
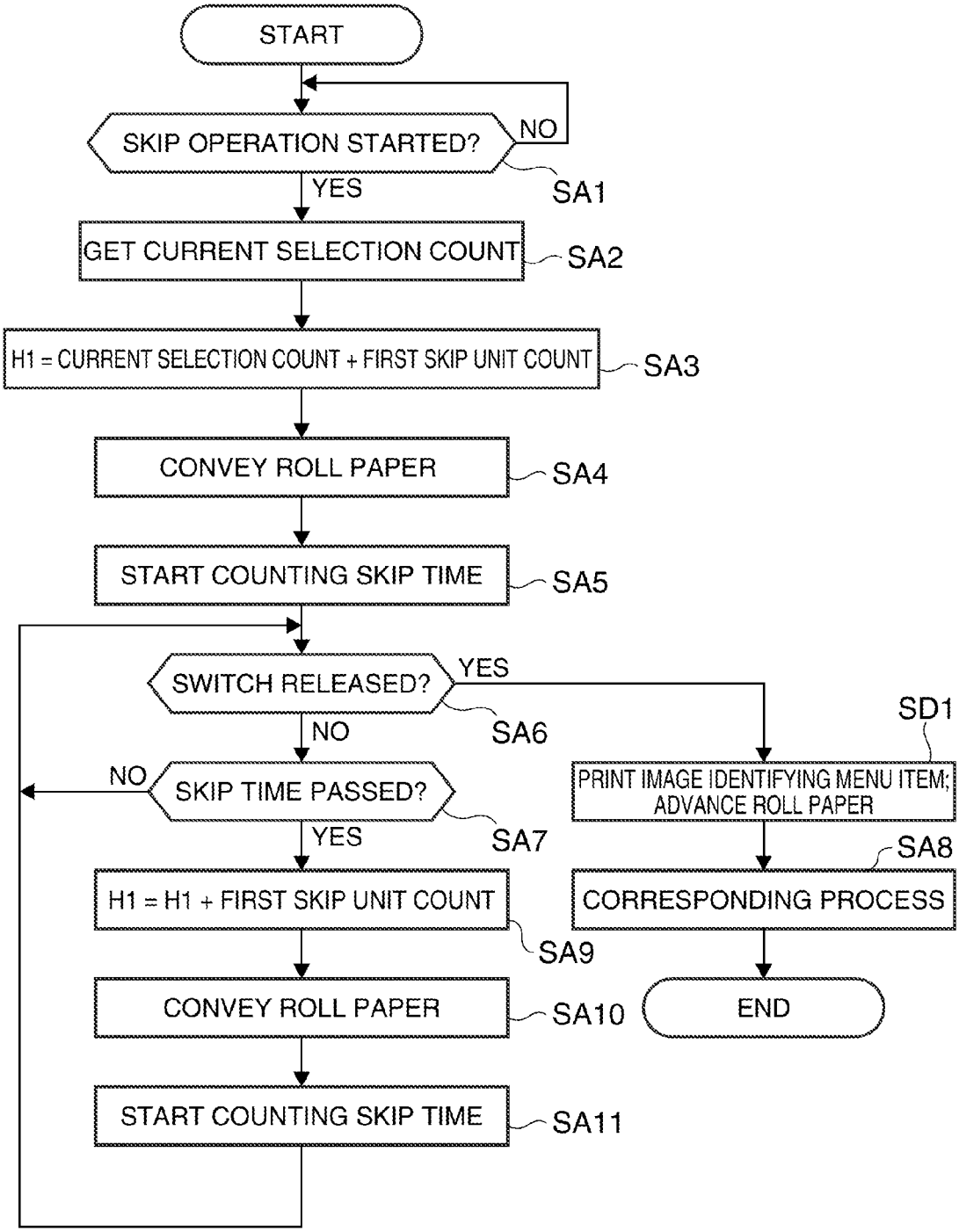
FIG. 10 is a flow chart of the operation of a printer according to an embodiment of the invention.

FIG. 10 is a flow chart of the operation of the printer 2*d* according to this embodiment of the invention.

As will be understood by comparing FIG. 10 and FIG. 4, this embodiment differs from the first embodiment by executing a step SD1 before step SA8.

As shown in FIG. 10, when the push switch 17 is released in step SA6 (step SA6 returns Yes) in this embodiment of the invention, the control unit 21 controls the print engine 20 to record information indicating the currently selected menu item on roll paper 10 and then advances the roll paper 10 (step SD1). Note that the control unit 21 references the selection operation count table 30 to retrieve the record storing the same selection operation count as the effective selection count stored in the variable H1, and gets the menu item data stored in the menu item field 32 of that record to acquire the menu item.

This embodiment of the invention thus records information indicating the selected menu item on the roll paper 10 only after the push switch 17 is released. Therefore, while the push switch 17 is held depressed, the resources used to print an image on the roll paper 10 are saved while still informing the user that the selected menu item changed. In addition, by recording information indicating the selected menu item on the roll paper 10 after depression of the push switch 17 is released, the user can reliably visually confirm the currently selected menu item.

As described above, this embodiment of the invention conveys the roll paper 10 without printing an image thereon each time the menu item selected in the menu changes by skipping a number of sequential items while the push switch 17 is pressed continuously, and when the push switch 17 is then released, information indicating the menu item selected when the push switch 17 was released is printed on the roll paper 10 and the roll paper 10 is conveyed.

Thus, while the push switch 17 is continuously held depressed, the roll paper 10 is conveyed without recording an image each time the selected menu item is changed by skipping intervening items. The user can therefore know from the advancement of the roll paper 10 and the sound produced by advancing the roll paper 10 that the selected menu item changed by skipping some items, and based on this recognition can know the currently selected menu item. More particularly, because an image is not recorded when the roll paper 10 is advanced while the push switch 17 is held continuously depressed, the resources used to record an image can be conserved. In addition, because information showing the menu item that was selected at the time the push switch 17 was released is printed on the roll paper 10 when continuous depression of the push switch 17 is released, the user can clearly visually confirm the currently selected menu item by reading the information recorded on the roll paper 10.

It should be understood that the embodiments described above can be changed and adapted in many ways without departing from the scope of the accompanying claims.

For example, the first embodiment skips the selected menu item three items every 1 second, but this time and the number of menu items that are skipped can be set appropriately according to the number of menu items. This obviously also applies to other embodiments of the invention.

Figure 11:
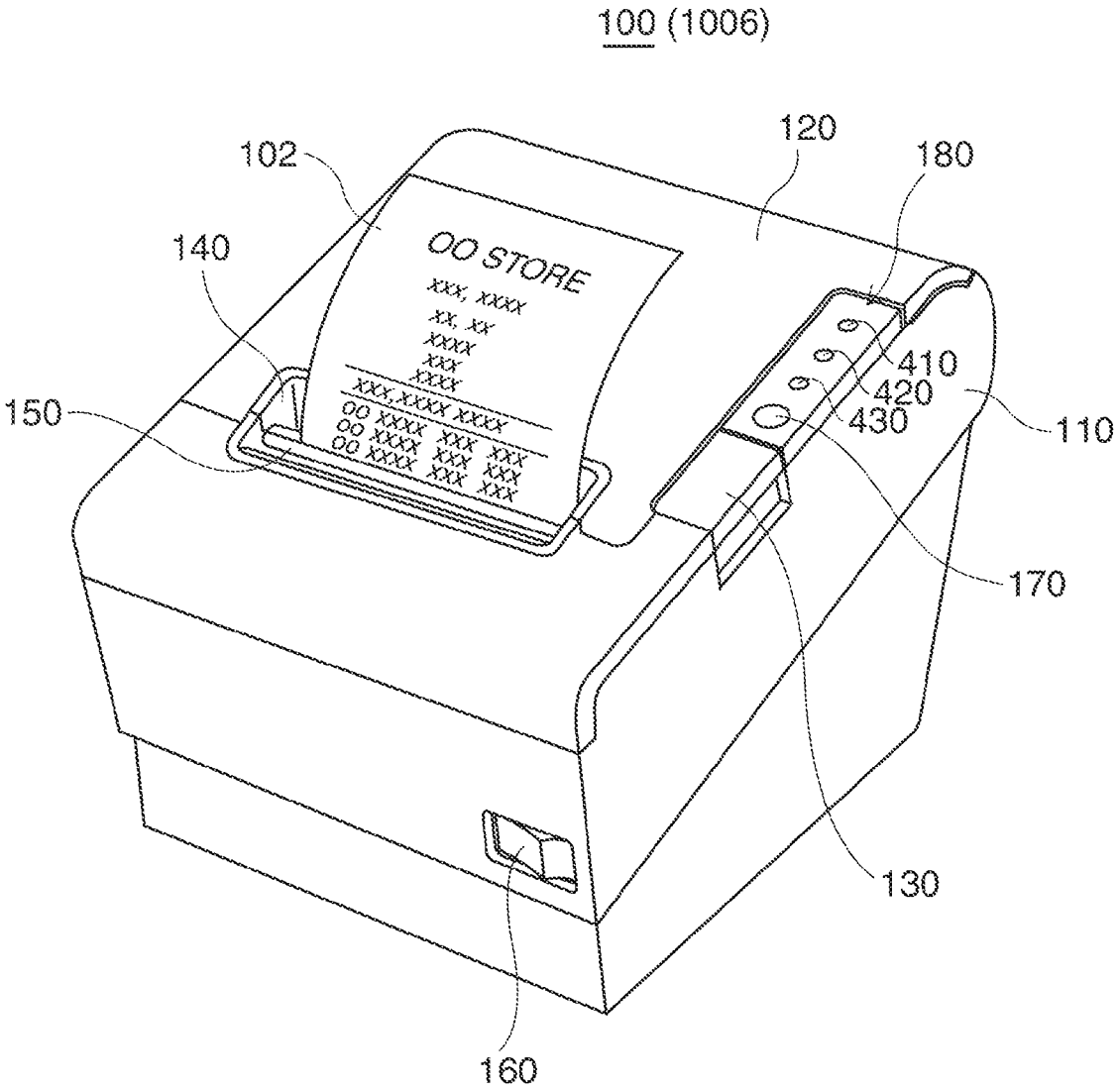
FIG. 11 is an oblique view of a printer according to an embodiment of the invention.

FIG. 11 is an external oblique view of a printer 100 according to a fifth embodiment of the invention.

The printer 100 shown in FIG. 11, as an example of a recording device, is a thermal printer that stores roll paper 102 inside the case 110, and prints text and images on the roll paper 102 by means of a thermal head (not shown) disposed inside the case 110 while conveying the roll paper 102. A cover 120 that can open and close is disposed to the case 110, and the cover 120 is released by depressing a lever 130. When the cover 120 is opened, a space for storing the roll paper 102 inside the case 110 is exposed, and the roll paper 102 can be loaded or replaced.

The printer 100 prints and outputs receipts in a retail store, for example, by printing (recording) a prepared logo and text on the roll paper 102.

A paper exit 140 for discharging the printed roll paper 102 is formed in the top of the printer 100 case 110. The printer 100 can also be installed with the paper exit 140 facing forward. A cutter 150 for cutting the roll paper 102 is disposed inside the paper exit 140. A power switch 160 for turning the printer 100 power on and off, a push switch 17 (operating switch) for asserting a paper feed instruction or changing the operating mode, for example, and an LED unit 180 for displaying the operating status of the printer 100, for example, are disposed to the case 110. The LED unit 180 includes a first LED 410, a second LED 420, and a third LED 430.

In addition to a power switch 160, the printer 100 according to this embodiment of the invention only has a push switch 170 as an operating switch. The printer 100 also does not have an LCD device or other type of display. The size and manufacturing cost of the printer 100 can therefore be reduced compared with a printer that has numerous operating switches or a printer that has a display device.

Figure 12:
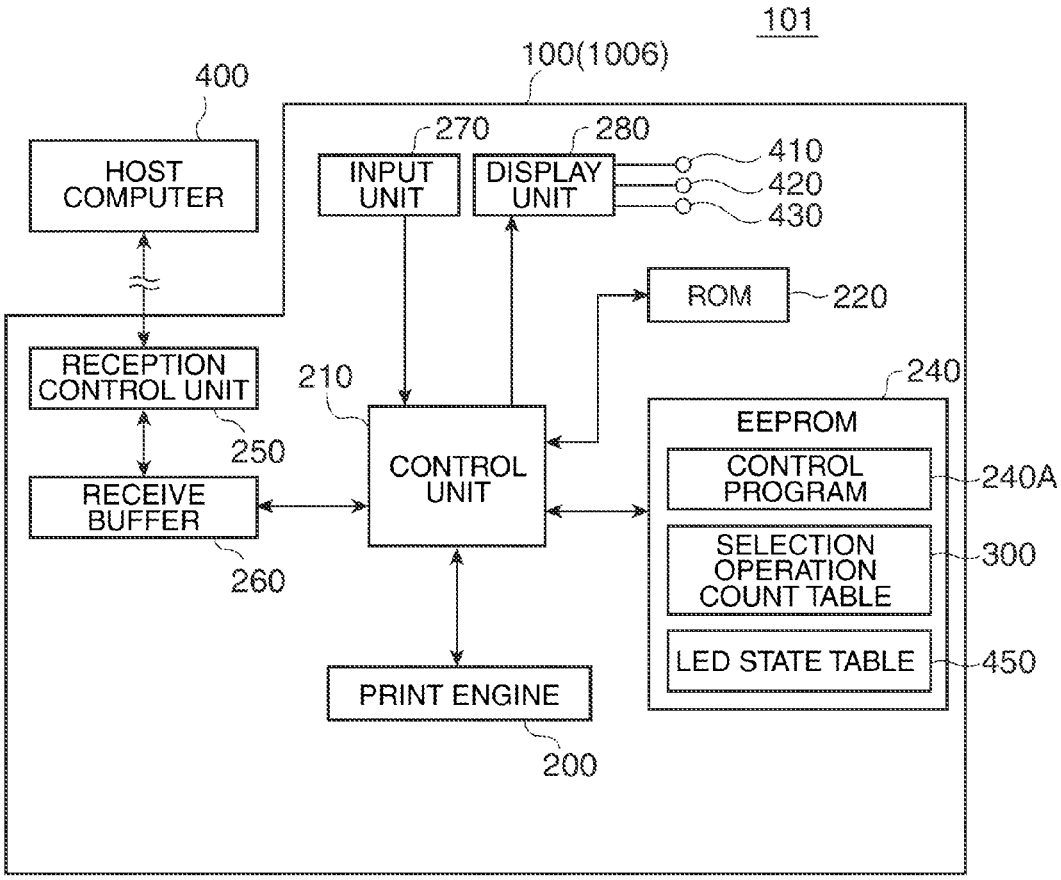
FIG. 12 is a block diagram showing the functional configuration of the printer of FIG. 11.

FIG. 12 is a block diagram showing the configuration of a printing system 101 according to this embodiment of the invention.

The printing system 101 is rendered by connecting a host computer 400 to the printer 100, and is a system in which the printer 100 prints the above-described receipts, for example, according to commands from the host computer 400.

The printer 100 includes a print engine 200 that does the actual printing, a control unit 210 that controls printer 100 operation, ROM 220 that stores the basic control program executed by the control unit 210, EEPROM 24 that stores a control program executed by the control unit 210, a reception control unit 250 that controls receiving commands sent from the host computer 400, a receive buffer 260 that temporarily stores commands and data received from the host computer 400, an input unit 270 that detects operation of the push switch 170, and a display unit 280 that controls operation of the first LED 410, second LED 420, and third LED 430.

The control unit 21 has a CPU and internal memory used as a working area for temporarily storing data and executed programs, and functions as a microcontroller that executes the basic control program stored in ROM 220 and the control program 240A stored in EEPROM 240. The control unit 210 can also execute various clock functions based on a reference clock generated by an oscillator not shown, and, based on detection signals input from the input unit 270 when the switch 170 is pressed can count the time from when the switch 170 was most recently pressed, until the switch 170 is released.

The print engine 200 renders the text or image printed on the roll paper 102, as controlled by the control unit 210, based on the print data and commands sent from the host computer 400, and controls the print mechanism of the printer 100 to print on the roll paper 102. More specifically, the printer 100 has a print head that applies heat to the printing surface of the roll paper 102, a print head drive mechanism that causes the print head to move relative to the roll paper 102, and a transportation mechanism that conveys the roll paper 102. The print head and other mechanisms are controlled by the print engine 200. In this embodiment of the invention the print head and print head drive mechanism function as a recording unit that records images on the roll paper 102, and the transportation mechanism functions as a transportation unit that conveys the roll paper 102.

The ROM 220 nonvolatilely stores a basic control program for initializing the various parts of the printer 100 and controlling said parts by means of the control unit 210, and stores data related to this basic control program.

The EEPROM 240 is a rewritable nonvolatile storage device, and stores the control program 240A for controlling other parts of the printer 100 by means of the control unit 210. The EEPROM 240 also stores a selection operation count table 300 and an LED state table 450. These tables are described in detail further below.

The reception control unit 250 implements a specific communication protocol for communication with the host computer 400, receives signals sent from the host computer 400, demodulates (decodes) the received signals, and extracts and sequentially stores the received commands and data in the receive buffer 260. The reception control unit 250 also includes, for example, a connector connected to a communication cable and a communication circuit, or a wireless communication circuit and antenna, for example.

The receive buffer 260 is temporary storage that sequentially stores the commands and data output by the reception control unit 250, and the commands and data stored in the receive buffer 260 are acquired by the control unit 210.

The printer 100 executes a print job when a command received by the reception control unit 25 is a command instructing execution of a print job and print data is received following the command.

The display unit 280 is connected to the first LED 410, second LED 420, and third LED 430, and controls the output state of the LEDs as instructed by the control unit 210. The first LED 410, second LED 420, and third LED 430 can each be controlled in three states, on, blinking, and off (for convenience, off is also considered an LED operating state), and the operation and status of the printer 100 can be reported by appropriately combining these three states. In addition, as further described below, when the operating mode is changed to the setup mode, the currently selected menu item is reported using two LEDs, that is, the first LED 410 and second LED 420.

Even when not connected to the host computer 400 and used in a stand-alone state, the printer 100 according to this embodiment of the invention can selectively execute such predetermined functions as a function for selecting the type of roll paper 102, a function for setting the print density for printing on the roll paper 102, and a function for setting the width of the roll paper 102. Note that a user as referred to herein includes the person using the printer 100, as well as maintenance and repair technicians and other people that may operate the printer 100.

More specifically, to use one of the provided functions, the user first enters the setup mode for selecting the operating mode of the printer 100. This setup mode is entered by executing a specific predetermined operation on the printer 100 (such as turning on the power switch 160 while holding the switch 170 depressed).

After setting the operating mode to the setup mode, the user presses the push switch 170 to select the menu item corresponding to the desired function and thereby executes said function.

The operation whereby a particular menu item is selected by the user in this embodiment of the invention is described below. In this embodiment of the invention the user can depress the push switch 170 to activate one of two states according to how long the push switch 170 is held depressed. These states are referred to herein as selection and confirm operations.

A selection operation is detected when the push switch 170 is pressed continuously for less than 2 seconds.

A confirm operation is detected when the push switch 170 is pressed continuously for more than 2 seconds.

The menu item that is selected when the user executes the confirm operation after executing the selection operation a specified number of times is predefined in this embodiment of the invention, and this correlation can be recorded in the operating manual, for example, and thereby be made knowable to the user. There is a 1:1 correlation between menu items and the corresponding functions, and the function corresponding to a particular menu item is executed when that menu item is selected.

In order to execute a particular function on the printer 100, the user must know the menu item corresponding to the desired function and then execute an operation to select that menu item, such as executing the selection operation six times and then executing the confirm operation to confirm the selection. This operation results in the menu item being selected and the function corresponding to the menu item being executed.

The operation of the printer 100 when selecting a menu item is described next.

FIG. 13 schematically describes the configuration of the selection operation count table 300.

As shown in FIG. 13, each record in the selection operation count table 300 includes a selection operation count field 310 and a menu item field 320.

The selection operation count field 310 stores the selection operation count denoting the number of times the push switch 170 was pressed to select before being pressed to finalize the selection.

The menu item field 320 stores menu item data indicating the menu item that is selected when the push switch 170 is pressed in the confirm mode, after being pressed the number of times defined by the selection count stored in the corresponding selection operation count field 31.

As shown in FIG. 13, the menu items are arranged in the selection operation count table 30 in a specific sequence corresponding to the number of times the push switch 17 is pressed in the selection mode. A menu refers to a group of menu items arranged in a specific order, according to the number of times a selection operation, is performed.

As described above, to execute a function, the user presses a button a specific number of times to choose the menu item corresponding to the desired function, and then presses the button to finalize the selection. During this operation the control unit 210 of the printer 100 counts the number of selection operations performed before the confirm operation was performed. Then the control unit 210 references the selection operation count table 300, when the confirm operation is executed, to retrieve the record in the selection operation count field 310 containing the selection operation count equal to the number of menu item selection operations that was counted. The control unit 210 then retrieves the menu item data stored in the menu item field 320 of the retrieved record, and reads and executes the program that renders the function corresponding to the menu item identified by the acquired menu item data. More specifically, the operation of the control unit 210 at this time sequentially changes the selected menu item each time the selection operation is performed, and when the confirm operation is performed executes the function corresponding to the currently selected menu item.

The selected menu item is the menu item indicated by the menu item data stored for the selection operation count data corresponding to the number of times the selection operation was performed until immediately before the confirm operation. Therefore, the menu item that is selected when the confirm operation is performed is confirmed as the selected menu item, and the function corresponding to that menu item is executed.

However, because the printer 100 according to this embodiment of the invention does not have an LCD device or other display, the user cannot use a display device to confirm the menu item that is selected when the user executes a selection operation after changing the operating mode to the setup mode and the selected menu item changes accordingly. Furthermore, while the user can refer to the operating manual, for example, to determine the number of selection operations and the menu item that will be selected when the confirm operation is executed after the specified number of selection operations, some users can easily lose track of or forget how many times the selection operation was done, and thus does not know the currently selected menu item.

The printer 100 according to this embodiment, among others, addresses this problem by the operation described below, and enables the user to confirm the currently selected menu item without using a display device, thereby reducing the size and manufacturing cost of the printer 100 accordingly.

The operation of the printer 100 according to this embodiment of the invention is described next with reference to the flow chart in FIG. 14.

Figure 14:
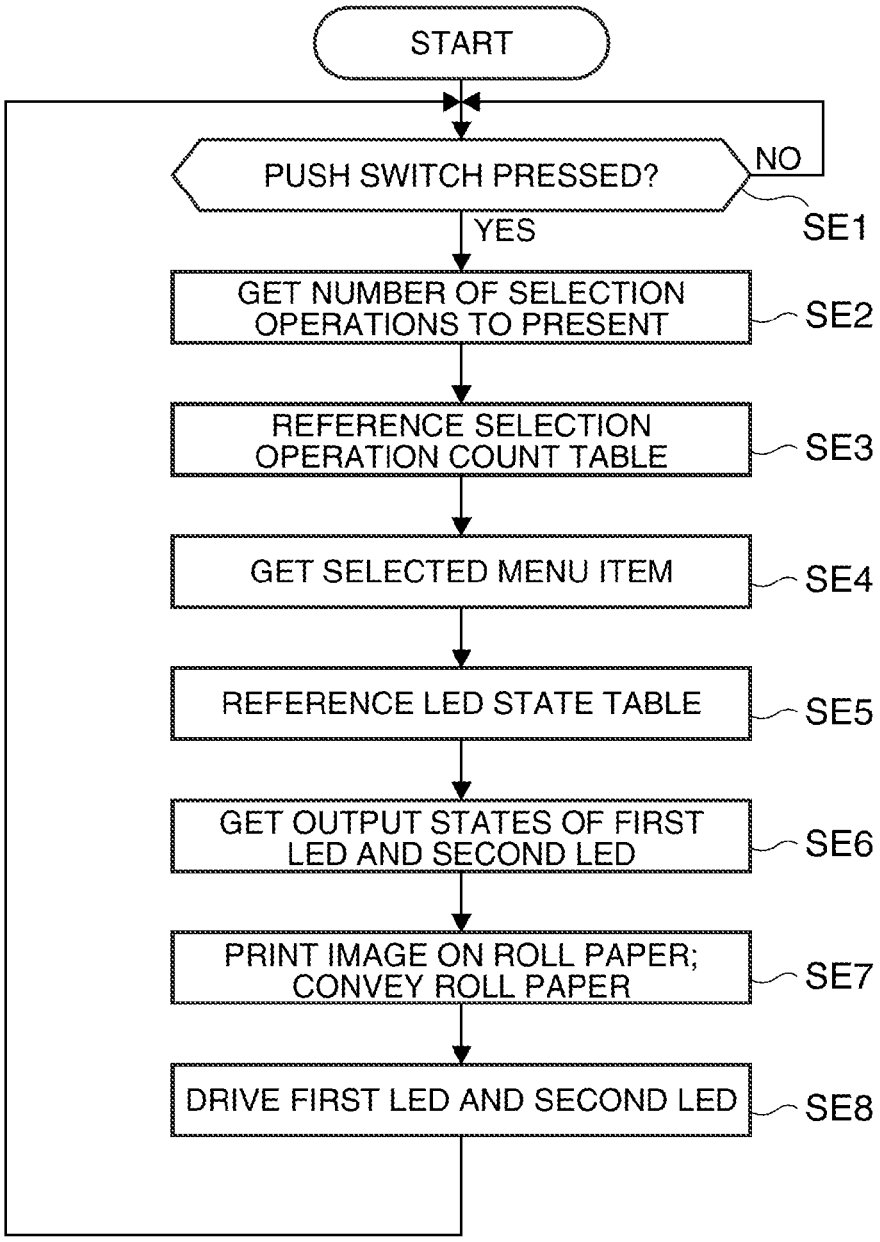
FIG. 14 is a flow chart of printer operation according to an embodiment of the invention.

The operation shown in the flow chart in FIG. 14 is rendered by the cooperation of hardware and software components, such as by the control unit 210 executing a control program 240A stored in ROM 220.

When the operation described by the flow chart in FIG. 14 starts, the operating mode is already set to the setup mode.

Based on a signal input from the input unit 270, the control unit 210 of the printer 100 monitors if the user pressed the push switch 170 (step SE1). If the user pressed the push switch 170 (step SE1 returns Yes), the control unit 210 gets the total number of times the push switch 170 was pressed to select a menu item (step SE2). The total number of times the selection operation was executed is stored, for example, in a variable defined by the control program 240A.

The control unit 210 then references the selection operation count table 300 (step SE3) and gets the menu item to be selected (step SE4). More specifically, the control unit 210 retrieves the record in which the value stored in the selection operation count field 310 equals the number of times the selection operation was executed, and retrieves the menu item data stored in the menu item field 320 of that record to acquire the menu item to be selected.

The control unit 210 then references the LED state table 450 (step SE5).

FIG. 15 shows the configuration of the LED state table 450.

The first LED 410 and second LED 420 operate in different output states according to the currently selected menu item in this embodiment of the invention. The LED state table 450 stores the output states of the first LED 410 and second LED 420 according to the menu item and when said menu item is the menu item to be selected.

Each record of the LED state table 450 has a menu item field 460, a first LED output state field 470, a second LED output state field 480, and a blinking operation field 490.

The menu item field 460 stores the menu item data indicating the menu item.

The first LED output state field 470 stores first output state data indicating the output state of the first LED 410. As described above, the first LED 410 has three output states, that is, on, blinking, and off.

The second LED output state field 480 stores second output state data indicating the output state of the second LED 420. As described above, the first LED 410 and the second LED 420 have three output states, that is, on, blinking, and off.

The blinking operation field 490 stores data indicating if the first LED 410 and second LED 420 blink synchronously or at different times when both are driven to blink. In the example shown in FIG. 16, the blinking operation field 490 of the first record stores data indicating that the blinking of the LEDs is not synchronized, and the blinking operation field 490 of the second record stores data indicating that the LEDs blink synchronously.

Note, further, that the menu items and the output states of the first LED 410 and second LED 420 when a particular menu item is the menu item to be selected are recorded in the operating manual, for example, and the menu item that is selected at the current time can be known from the output states of the first LED 410 and second LED 420.

After referencing the LED state table 450 in step SE5, the control unit 210 acquires the output states of the first LED 410 and second LED 420 based on the selected menu item determined in step SE4 (step SE6). More specifically, the control unit 210 identifies the record containing the menu item data indicating the selected menu item in the menu item field 460, retrieves the data from the first LED output state field 470, second LED output state field 480, and blinking operation field 490 of the identified record, and determines the output states of the first LED 410 and second LED 420 identified by this data.

The control unit 210 then controls the print engine 200, prints an image showing the selected menu item acquired in step SE4 on the roll paper 102, and advances the roll paper 102 until the printed portion of the roll paper 102 is discharged from the paper exit 140 and the user can see the image showing the selected menu item printed on the roll paper 102 (step SE7).

Figure 16:
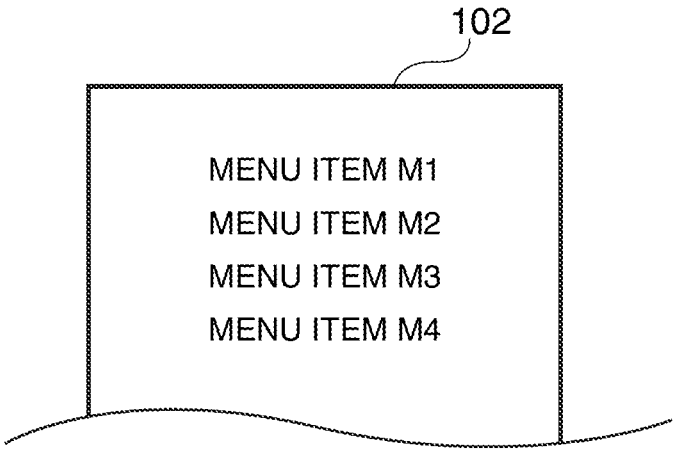
FIG. 16 shows roll paper on which images showing the selected menu item are recorded according to an embodiment of the invention.

FIG. 16 shows a sample of the roll paper 102 on which images indicating the selected menu item are printed.

The user can confirm the currently selected menu item by reading the image showing the selected menu item printed on the roll paper 102 as shown in FIG. 16.

The control unit 210 then drives the first LED 410 and second LED 420 in the output states of the first LED 410 and second LED 420 acquired in step SE6 (step SE8). Thus, the first LED 410 and second LED 420 output in the output state corresponding to the currently selected menu item, and the user can confirm the currently selected menu item by reading the output of the first LED 410 and second LED 420.

The control unit 210 then returns to step SE1.

As described above, the printer 100 according to this embodiment of the invention records an image corresponding to the operating state of the push switch 170 on the roll paper 102 and conveys the roll paper 102 so that the printed image can be seen.

Thus, when the push switch 170 is pressed, an image corresponding to the push switch 170 operation is printed on the recording paper, and the roll paper 102 is conveyed so that the printed image can be seen. Whether or not the operation of the push switch 170 is accurately reflected can be confirmed without disposing an LCD or other type of display to the printer 100, and the size and manufacturing cost of the recording device can be reduced by the omission of a display device.

Each time the push switch 170 is operated and the selected menu item changes, the printer 100 according to this embodiment of the invention records an image showing the menu item after the selected menu item is changed on the roll paper 102, and conveys the roll paper 102 so that the printed image can be seen.

Thus, because an image indicating the menu item selected after the menu item is changed is recorded on the roll paper 102 each time the selected menu item is changed, and the roll paper 102 is then advanced so that the recorded image can be seen, the user can confirm the menu item after the menu item is changed every time the switch is pressed to change the menu item.

A printer 100 according to this embodiment of the invention has a plurality of LEDs, specifically a first LED 410 and second LED 420 in this embodiment, and reports the selected menu item using the output state of these LEDs.

Thus, the selected menu item can be reliably and easily confirmed both by reading the image on the roll paper 102 and reading the output states of the plural LEDs.

The configuration of a printer 100*b* according to a sixth embodiment of the invention is the same as the configuration of the printer 100 according to the fifth embodiment of the invention, and further description thereof with reference to FIG. 11 and FIG. 12 is omitted.

Figure 17:
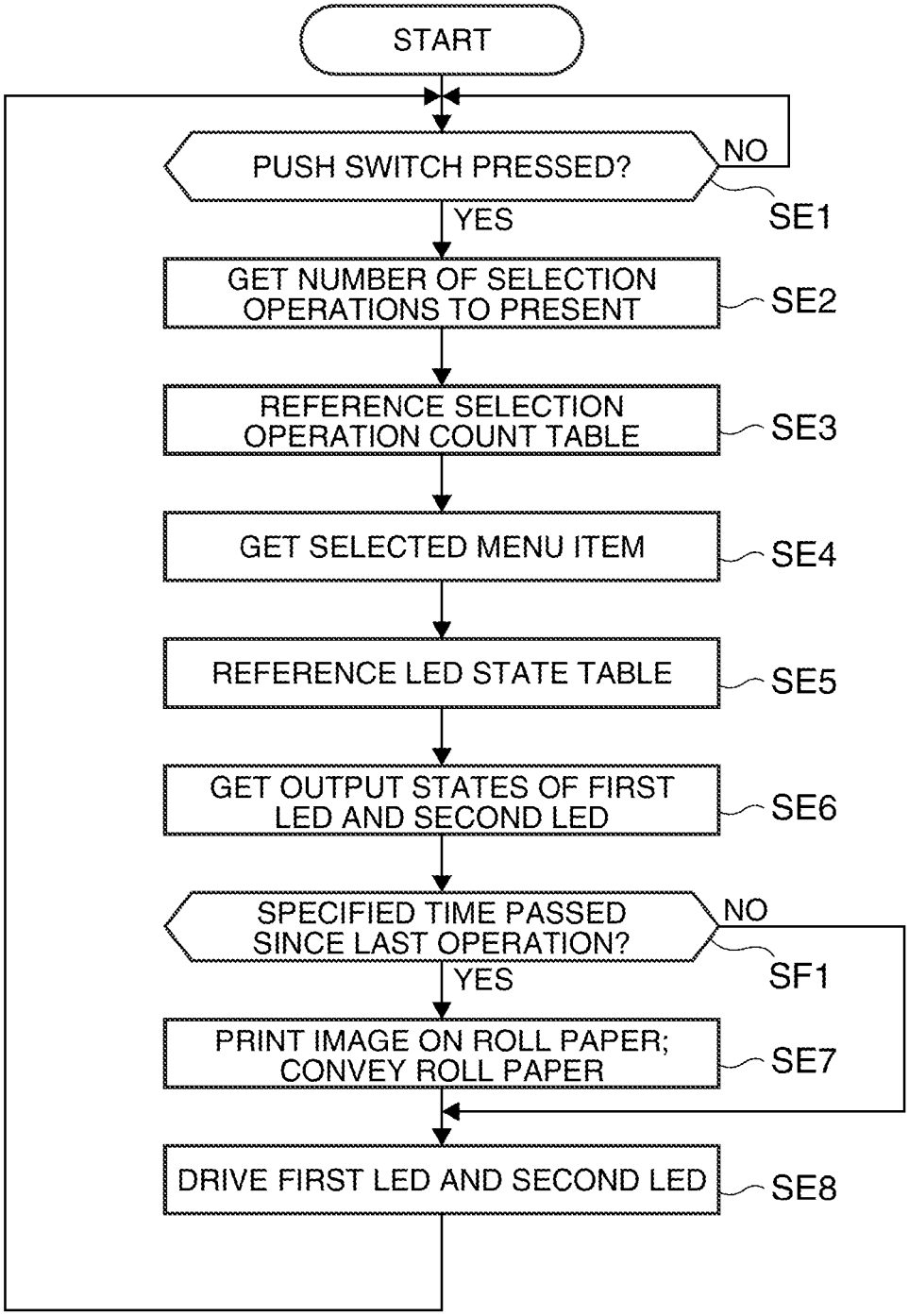
FIG. 17 is a flow chart of the operation of a printer according to an embodiment of the invention.

FIG. 17 is a flow chart describing the operation of the printer 100*b* according to this embodiment of the invention.

As will be known by comparing FIG. 14 and FIG. 17, this embodiment differs from the fifth embodiment in the inclusion of step SF1.

Referring to FIG. 17, after step SE6, the control unit 210 of the printer 100*b* determines if pressing the push switch 170 detected in step SE1 occurred after a specified time had passed since the most recent time the push switch 170 was pressed (step SF1). This most recent time the push switch 170 was pressed is the last time the push switch 170 was pressed before pressing the push switch 170 was detected in step SE1. If the specified time has passed (step SF1 returns Yes), the control unit 210 goes to step SE7, records an image on the roll paper 102, and advances the roll paper 102. If the specified time has not passed (step SF1 returns No), the control unit 210 goes to step SE8.

As a result of this operation, an image indicating the selected menu item is printed on the roll paper 102 and the roll paper 102 is advanced when the push switch 170 is pressed again a specified time after the push switch 170 was last pressed, but an image is not recorded and the paper is not advanced when this specified time has not passed.

If the push switch 170 is pressed at a frequent interval to select a menu item, the user conceivably knows and is confident about how many times the selection operation must be performed, and is therefore pressing the push switch 170 at a short interval with confidence. However, if the push switch 170 is pressed to select a menu item a relatively long time after the push switch 170 was last pressed to select a menu item, the user may have forgotten how many times the push switch 170 was pressed and may be wondering whether or not to press the push switch 170. Thus, an image showing the selected menu item is recorded on the roll paper 102 and the roll paper 102 is advanced only when the push switch 170 is pressed a specified time after the push switch 170 was last pressed. Use of the resources needed to print and convey the paper can therefore be suppressed while the currently selected menu item can be reliably reported to the user when there is the possibility that the user has forgotten how many times a menu item selection was made and does not know the currently selected menu item. In addition, by executing the selection operation after a specified time has passed since the last selection operation, the user can confirm the currently selected menu item.

As described above, when the push switch 170 is pressed to select a menu item and the selected menu item changes, and the menu item changed a specified time after the last (most recent) menu item change, the printer 100*b* according to this embodiment of the invention records an image showing the menu item to which the menu item changed to the roll paper 102, and advances the roll paper 102 so that the printed image can be seen.

Thus, the use of resources needed to print an image on and advance the roll paper 102 can be suppressed, and the currently selected menu item can be reliably confirmed by not changing the menu item for a specified time after the menu item was most recently changed.

It should be understood that the embodiments described herein can be changed and adapted in many ways without departing from the scope of the accompanying claims. It further should be understood that the described solutions (i.e., embodiments) herein are examples, and are not exclusive to correspondingly described problems.

For example, in this embodiment the first LED 410 and second LED 420 are always driven when in the setup mode to output according to the currently selected menu item so that the user can know what menu item is currently selected, but the currently selected menu item may also be reported by means of the LEDs when the paper supply runs out or an LED drive command is asserted.

Furthermore, an example of roll paper 102 on which an image showing the selected menu item is printed is shown in FIG. 16, but the image recorded on the roll paper 102 is obviously not limited to an image such as shown in FIG. 16. In addition, the output states of the LEDs are obviously not limited to the output states shown in the LED state table 450 in FIG. 15.

The processes executed by the recording devices described in the foregoing embodiments can also be rendered as a program. In addition, said program can be distributed stored on a recording medium such as a hard disk drive, optical disc, magneto-optical disk, or flash memory device.

Although the present invention has been described in connection with the preferred embodiments thereof with reference to the accompanying drawings, it is to be understood that various changes and modifications will be apparent to those skilled in the art. Such changes and modifications are to be understood as included within the scope of the present invention as defined by the appended claims.

What is claimed is:

1. A recording device comprising:

a control unit;

a print engine coupled to the control unit; and an operating unit configured to receive user input and being coupled to the control unit, wherein the control unit is configured to access a menu of the recording device based on a user input physically applied to the recording device, the menu including a plurality of selectable menu items arranged in a sequential order, wherein the control unit is configured to change a selected menu item by skipping at least one sub-plurality of the menu items based on the user input to the operating unit, wherein the recording device does not include a display screen, and configured to convey and print paper, wherein each time at least one sub-plurality of menu items is skipped, the paper is incrementally conveyed to inform the user that the at least one sub-plurality of menu items has been skipped, wherein each sub-plurality of menu items comprises a specific number of menu items are skipped each time a specific time period passes while the operating unit is operated continuously with the user input, wherein the specific number of sub-plurality of menu items of subsequent sub-pluralities of menu items increases with continuous operation of the operating unit.

2. The recording device of claim 1, wherein the paper is incrementally conveyed without an image being recorded.

3. The recording device of claim 1, wherein each time a sub-plurality of menu items is skipped, information indicating which menu item is selected is recorded by the recording unit on the paper.

4. A recording device comprising:

a control unit;

a print engine coupled to the control unit; and an operating unit configured to receive user input and being coupled to the control unit, wherein the control unit is configured to access a menu of the recording device based on a user input physically applied to the recording device, the menu including a plurality of selectable menu items arranged in a sequential order, wherein the control unit is configured to change a selected menu item by skipping at least one sub-plurality of the menu items based on the user input to the operating unit, wherein the recording device does not include a display screen, and configured to convey and print paper, wherein each time at least one sub-plurality of menu items is skipped, the paper is incrementally conveyed to inform the user that the at least one sub-plurality of menu items has been skipped, wherein during continuous operation of the operating unit, each time a sub-plurality of menu items is skipped, the paper is conveyed without an image being recorded, and wherein when continuous operation of the operating unit ends, information indicating which menu item is selected is recorded on the paper.

5. A method of controlling a recording device that has an operating unit, the method comprising:

receiving a user input physically applied at the operating unit to change a current menu item out of a plurality of sequentially accessible menu items;

determining that the user input is intended to change the current menu item;

skipping at least one sub-plurality of menu items sequentially arranged after the current menu item to a new menu item based on the user input;

indicating to the user via the recording device that at least one sub-plurality of menu items has been skipped to the new menu item, wherein the recording device does not have a display screen, wherein the recording device is configured to convey and print paper;

wherein indicating comprises that each time at least one sub-plurality of menu items is skipped, the paper is incrementally conveyed to inform the user that the at least one sub-plurality of menu items has been skipped, wherein indicating further comprises recording an indication of the new menu item on paper, wherein determining further comprises determining that the user input is continuous over a first predetermined amount of time from initiation of the user input, the first predetermined amount of time being related to the amount of menu items in the sub-plurality, the method further comprising:

determining the user input is continuous over at least a second predetermined amount of time from the initiation and skipping at least a second sub-plurality of menu items; and determining that the user input has ended, wherein indication of a new menu item is only recorded after the user input has ended after the second predetermined period of time, and wherein the paper is respectively conveyed after each first and second predetermined periods of time.

6. A method of controlling a recording device that has an operating unit, the method comprising:

receiving a user input physically applied at the operating unit to change a current menu item out of a plurality of sequentially accessible menu items;

determining that the user input is intended to change the current menu item;

skipping at least one sub-plurality of menu items sequentially arranged after the current menu item to a new menu item based on the user input;

indicating to the user via the recording device that at least one sub-plurality of menu items has been skipped to the new menu item, wherein the recording device does not have a display screen, wherein the recording device is configured to convey and print paper;

wherein indicating comprises that each time at least one sub-plurality of menu items is skipped, the paper is incrementally conveyed to inform the user that the at least one sub-plurality of menu items has been skipped, wherein indicating further comprises recording an indication of the new menu item on paper, wherein determining further comprises determining that the user input is continuous over a first predetermined amount of time from initiation of the user input, the first predetermined amount of time being related to the amount of menu items in the sub-plurality, the method further comprising:

determining that the user input is continuous over at least a second predetermined amount of time from the initiation and skipping at least a second sub-plurality of menu items; and determining that the user input has ended, wherein indications of new menu items are respectively recorded after each of the first and second predetermined periods of time, and wherein the paper is respectively conveyed after each first and second predetermined periods of time.

7. A non-transitory computer-readable recording medium on which is recorded a program, which when executed by the control unit performs the method of at least claim 5 or claim 6.

8. A recording device comprising:

a control unit configured to control the recording device to convey and print paper;

an operating unit configured to receive physically applied user input and being coupled to the control unit;

wherein the control unit comprises a menu including a plurality of selectable menu items arranged in a sequential order, wherein when the operating unit receives a user input to select one of the menu items, the control unit is configured to control the recording device to record at least one corresponding image and convey the paper, and further comprising a plurality of light emitting diodes (LEDs) coupled to the control unit; wherein the control unit is configured to report the selected menu item by controlling the output states of the plurality of LEDs, wherein the recording device does not include a display screen, wherein the control unit is configured to record and convey each time a menu item is changed, wherein the control unit is configured to record and convey only after a specific amount of time has passed after the operating unit received a previous user input.

9. A method of controlling a recording device that has an operating unit, the method comprising:

receiving a user input at the operating unit to change a current menu item out of a plurality of sequentially accessible menu items;

determining that the user input is intended to change the current menu item;

recording an image corresponding to the current menu item;

conveying paper to display the corresponding image, and controlling the output states of a plurality of light emitting diodes to report the current menu item, wherein the recording device does not include a display screen, wherein recording and conveying occurs only after a specific amount of time has passed after the operating unit received a previous user input.

10. A non-transitory computer-readable recording medium on which is recorded a program, which when executed by the control unit performs the method of at least claim 9.

* * * * *